US009969205B2

(12) United States Patent
Kawasaki

(10) Patent No.: US 9,969,205 B2
(45) Date of Patent: May 15, 2018

(54) PRESSURE FLUCTUATION BUFFERING MECHANISM AND APPLICATOR

(71) Applicants: V SPARK Co., Ltd., Saitama-shi, Saitama (JP); CHEMICOS CREATIONS LTD., Tokyo (JP)

(72) Inventor: Masayuki Kawasaki, Soka (JP)

(73) Assignees: CHEMICOS CREATIONS LTD., Tokyo (JP); V SPARK CO., LTD., Saitama-shi, Saitama (JP)

( * ) Notice: Subject to any disclaimer, the term of this patent is extended or adjusted under 35 U.S.C. 154(b) by 93 days.

(21) Appl. No.: 15/031,134

(22) PCT Filed: Sep. 30, 2014

(86) PCT No.: PCT/JP2014/076111
§ 371 (c)(1),
(2) Date: Apr. 21, 2016

(87) PCT Pub. No.: WO2015/060078
PCT Pub. Date: Apr. 30, 2015

(65) Prior Publication Data

US 2016/0250884 A1 Sep. 1, 2016

(30) Foreign Application Priority Data

Oct. 21, 2013 (JP) ..... 2013-218159
Nov. 25, 2013 (JP) ..... 2013-242610

(51) Int. Cl.
*B43K 8/04* (2006.01)
*B43K 7/10* (2006.01)
(Continued)

(52) U.S. Cl.
CPC ..... *B43K 8/04* (2013.01); *B43K 8/02* (2013.01); *B43K 8/03* (2013.01); *B43K 8/08* (2013.01); *B43K 23/128* (2013.01); *B43K 7/105* (2013.01)

(58) Field of Classification Search
CPC ..... B43K 8/04; B43K 7/10; B43K 7/105
(Continued)

(56) References Cited

U.S. PATENT DOCUMENTS 4,671,692 A * 6/1987 Inaba ..... B43K 7/10 401/199
5,217,313 A * 6/1993 Tamura ..... B43K 7/005 346/140.1
2003/0180084 A1 9/2003 Firukawa et al.

FOREIGN PATENT DOCUMENTS

EP 0 469 465 A1 2/1992
JP 62-28458 U 2/1987
(Continued)

OTHER PUBLICATIONS

PCT/ISA/210 issued in PCT/JP2014/076111 with English translation dated Dec. 16, 2014 (13 pagges).
(Continued)

*Primary Examiner* — David Walczak
*Assistant Examiner* — Joshua Wiljanen
(74) *Attorney, Agent, or Firm* — Flynn, Thiel, Boutell & Tanis, P.C.

(57) ABSTRACT

A pressure fluctuation buffering mechanism includes a buffer space connected to a brush via a paint flow space (a paint tank and a paint feeder) through which paint flows. The pressure fluctuation buffering mechanism buffers pressure fluctuations in the paint tank by the flow of paint and air between the paint flow space and the buffer space. The pressure fluctuation buffering mechanism includes a first buffer space forming member for forming a first buffer space
(Continued)

in the buffer space, and a second buffer space forming member for forming a second buffer space in the buffer space. The paint between the first buffer space and the paint flow space flows more easily than the paint between the second buffer space and the paint flow space.

12 Claims, 17 Drawing Sheets

(51) Int. Cl.

| | |
|---|---|
| ***B43K 8/02*** | (2006.01) |
| ***B43K 8/03*** | (2006.01) |
| ***B43K 8/08*** | (2006.01) |
| ***B43K 23/12*** | (2006.01) |

(58) Field of Classification Search
USPC ..... 401/223, 224, 225

See application file for complete search history.

(56) References Cited

FOREIGN PATENT DOCUMENTS

| | | | |
|---|---|---|---|
| JP | 6-20082 | U | 3/1994 |
| JP | 6-53186 | U | 7/1994 |
| JP | 7-195889 | A | 8/1995 |
| JP | 2514873 | Y2 | 10/1996 |
| JP | 9-267594 | A | 10/1997 |
| JP | 2004-42292 | A | 2/2004 |
| NL | 8000224 | A | 8/1981 |
| WO | WO 98/17482 | A1 | 4/1998 |

OTHER PUBLICATIONS

PCT/ISA/220 issued in PCT/JP2014/076111 dated Dec. 16, 2014 (2 pages).
PCT/ISA/237 issued in PCT/JP2014/076111 dated Dec. 16, 2014 (14 pages).
Search Report of European Patent Office issued in Application No. 14856171 dated Dec. 22, 2016 (4 pages).
Japanese Office Action issued in Appln. No. 2013-242610 dated Jul. 21, 2015 (4 pages).

* cited by examiner (A)

(B)

PRESSURE FLUCTUATION BUFFERING MECHANISM AND APPLICATOR

TECHNICAL FIELD

The present invention relates to a pressure fluctuation buffering mechanism and an applicator.

BACKGROUND ART

Applicators (for example, fountain pens) including an ink tank for accommodating ink have been known in the art. Various problems occur when a pressure fluctuation is generated in the ink tank due to variations in the environmental conditions (such as pressure or ambient temperature) under which such an applicator is used. For example, if the pressure in the ink tank is increased, the ink leaks from a nib. If the pressure in the ink tank is decreased, on the other hand, the ink has a difficulty in being discharged from the nib.

To solve such a problem, a writing instrument having a pressure fluctuation buffering mechanism including: a comb groove for retaining ink; an ink flow groove provided perpendicular to the comb groove; and an air flow groove provided perpendicular to the comb groove to solve the problem caused by pressure fluctuation in an ink tank has been known in the art (for example, Japanese Examined Utility Model Application Publication No. Sho. 62-028458).

SUMMARY OF INVENTION

Technical Problem

However, the buffering ability of the pressure fluctuation buffering mechanism provided in the writing instrument described in the aforementioned literature has limitations.

Diligent studies made by the present inventor have led to the acquisition of knowledge that a shorter length of the pressure fluctuation buffering mechanism in an axial direction (direction moving from the ink tank toward the nib) is preferred, the largest possible thickness of the pressure fluctuation buffering mechanism is preferred, and the fulfillment of both is more preferred in order to enhance the buffering ability of the pressure fluctuation buffering mechanism as much as possible. To derive the highest possible buffering ability of the pressure fluctuation buffering mechanism, however, the shape of the whole writing instrument becomes short and thick. Such a short and thick writing instrument is hard to be gripped, and therefore impractical to use.

An ink guiding core for feeding ink from the ink tank to the nib is inserted into the pressure fluctuation buffering mechanism provided in the aforementioned writing instrument (for example, the aforementioned literature). However, the inserting structure of the ink guiding core disturbs the flow performance of the ink guiding core. Due to the disturbance of the flow performance of the ink guiding core, the pressure fluctuation buffering mechanism fails to exert the desired performance.

The diligent studies made by the present inventor have led to the acquisition of knowledge that at least one of (i) and (ii) described below is required to ensure the flow performance of the ink guiding core.

(i) To separate a guiding core holding structure that holds the ink guiding core for feeding ink from the ink tank to the nib from the pressure fluctuation buffering mechanism.

(ii) To facilitate the flow of ink and air between the ink tank and the ink guiding core.

In light of such circumstances, an object of the present invention is to provide a pressure fluctuation buffering mechanism having an extremely high ability to buffer pressure fluctuations and is capable of maintaining its practicality even when applied to a writing instrument, for example. Furthermore, an object of the present invention is to provide a pressure fluctuation buffering mechanism capable of ensuring the flow performance of an ink guiding core. Additionally, an object of the present invention is to provide an applicator including such a pressure fluctuation buffering mechanism.

Solution to Problem

Owing to the diligent researches made by the present inventor, the above-described objects can be achieved by the following means.

The present invention provides a pressure fluctuation buffering mechanism, including a buffer space connected to an application member via a paint flow space through which paint flows, for buffering pressure fluctuations in the paint flow space by the flow of paint and air between the paint flow space and the buffer space. The pressure fluctuation buffering mechanism includes: a first buffer space forming member for forming a first buffer space in the buffer space; and a second buffer space forming member for forming a second buffer space in the buffer space. The paint between the first buffer space and the paint flow space flows more easily than the paint between the second buffer space and the paint flow space.

Preferably, the second buffer space is directly connected to the application member.

Preferably, the first buffer space forming member includes a first paint flow channel forming member disposed in the first buffer space for forming a first paint flow channel, and a first air flow channel forming member disposed in the first buffer space for forming a first air flow channel; the second buffer space forming member includes a second paint flow channel forming member disposed in the second buffer space for forming a second paint flow channel, and a second air flow channel forming member disposed in the second buffer space for forming a second air flow channel; and the paint in the first paint flow channel flows more easily than the paint in the second paint flow channel. Moreover, the pressure fluctuation buffering mechanism preferably includes a plurality of first plates each provided with a first paint cutout and arranged at predetermined intervals, and a plurality of second plates each provided with a second paint cutout and arranged at predetermined intervals; the first paint flow channel is preferably formed by a portion between the first plates and the first paint cutout; the first air flow channel is preferably formed around the first plate; the second paint flow channel is preferably formed by a portion between the second plates and the second paint cutout; and the second air flow channel is preferably formed around the second plate. Furthermore, the plurality of first plates are preferably each provided with a first air cutout, and the first air cutout preferably forms the first air flow channel. Additionally, the second paint flow channel is preferably opened to the application member. Further, the second buffer space forming member preferably includes an external connection channel for connecting the second air flow channel to an external space, and a paint reserving portion provided in the external connection channel for reserving the paint.

Preferably, the paint flow space includes a paint accommodation space for accommodating the paint, and a paint feed space for feeding the paint from the paint accommodation space to the application member; the first buffer space forming member includes a first connection channel for connecting between the first buffer space and the paint feed space; and the second buffer space forming member includes a second connection channel for connecting between the second buffer space and the paint feed space. Moreover, the second connection channel is preferably positioned between the first connection channel and the application member. Furthermore, the paint feed space preferably accommodates a paint feed core for feeding the paint from the paint accommodation space to the application member. Additionally, at least one of the first buffer space and the second buffer space is preferably provided with an air reserving portion; and the air reserving portion is preferably opposed to the first connection channel via the first paint flow channel formed in the first buffer space or opposed to the second connection channel via the second paint flow channel formed in the second buffer space. Further, the first connection channel opposed to the air reserving portion or the second connection channel opposed to the air reserving portion preferably functions as a flow channel for the air as well as a flow channel for the paint.

Preferably, the paint flow space includes a paint accommodation space for accommodating the paint, and a paint feed space for feeding the paint from the paint accommodation space to the application member; and the first buffer space and the second buffer space are positioned in the paint feed space.

The present invention provides a pressure fluctuation buffering mechanism, including a buffer space connected to an application member via a paint flow space through which the paint flows, for buffering pressure fluctuations in the paint flow space by the flow of paint and air between the paint flow space and the buffer space. The buffer space is directly connected to the application member.

The present invention provides a pressure fluctuation buffering mechanism, including a buffer space connected to an application member via a paint flow space through which the paint flows, for buffering pressure fluctuations in the paint flow space by the flow of paint and air between the paint flow space and the buffer space. The pressure fluctuation buffering mechanism includes a buffer space forming member for forming the buffer space. The buffer space forming member includes: an external connection channel for connecting an air flow channel formed in the buffer space to an external space; and a paint reserving portion provided in the external connection channel for reserving the paint.

The present invention provides a pressure fluctuation buffering mechanism, including a buffer space connected to an application member via a paint flow space through which the paint flows, for buffering pressure fluctuation in the paint flow space by the flow of paint and air between the paint flow space and the buffer space. The pressure fluctuation buffering mechanism includes a buffer space forming member for forming the buffer space. The paint flow space includes: a paint accommodation space for accommodating the paint; and a paint feed space for feeding the paint from the paint accommodation space to the application member. The buffer space forming member includes a connection channel for connecting between the buffer space and the paint feed space. The buffer space is provided with an air reserving portion. The air reserving portion is opposed to the connection channel via a paint flow channel formed in the buffer space.

The connection channel opposed to the air reserving portion preferably functions as a flow channel for the air as well as a flow channel for the paint.

A pressure fluctuation buffering mechanism of the present invention includes: a feed core supporting structure for supporting a first core portion of a paint feed core for feeding paint from a paint accommodation space to an application member; a feed core locking structure for locking a second core portion of the paint feed core; and a pressure fluctuation buffering structure, including a buffer space connected to the paint accommodation space, for buffering pressure fluctuations in the paint accommodation space by the flow of the paint and air between the paint accommodation space and the buffer space. The pressure fluctuation buffering structure is formed in the feed core supporting structure.

A communicating channel for connecting between a portion of the paint feed core closer to the application member than the second core portion and the paint accommodation space is preferably included.

A pressure fluctuation buffering mechanism of the present invention includes: a feed core supporting structure for supporting a first core portion of a paint feed core for feeding paint from a paint accommodation space to an application member; a feed core locking structure for locking a second core portion of the paint feed core; and a pressure fluctuation buffering structure, including a buffer space connected to the paint accommodation space, for buffering pressure fluctuations in the paint accommodation space by the flow of the paint and air between the paint accommodation space and the buffer space. The pressure fluctuation buffering mechanism includes a communicating channel for connecting between a portion of the paint feed core closer to the application member than the second core portion and the paint accommodation space.

A connecting structure disposed between the feed core supporting structure and the feed core locking structure for connecting between the feed core supporting structure and the feed core locking structure is preferably included. Moreover, the feed core supporting structure is preferably a cylindrical body for accommodating the first core portion; the connecting structure preferably extends from an end face of the cylindrical body closer to the paint accommodation space toward the paint accommodation space; and the feed core locking structure is preferably provided on the paint accommodation space-side of the connecting structure.

The feed core locking structure is preferably positioned in the paint accommodation space. Moreover, the feed core supporting structure and the feed core locking structure are preferably formed integrally. Furthermore, the feed core locking structure preferably includes a fit portion to be fit to the second core portion. Additionally, the feed core locking structure preferably includes a press-fit portion into which the second core portion is press-fit. Furthermore, the feed core locking structure preferably includes a weld portion to be welded with the second core portion.

The second core portion is preferably positioned in the paint accommodation space. Moreover, a portion closer to the paint accommodation space than the second core portion is preferably positioned in the paint accommodation space.

Preferably, a paint flow channel and an air flow channel are formed in the buffer space; the pressure fluctuation buffering structure includes a plurality of plates each being provided with a paint cutout and an air cutout and arranged in the buffer space at predetermined intervals; the paint flow channel is formed by the paint cutout; and the air flow channel is formed by the air cutout.

The present invention provides a pressure fluctuation buffering mechanism, including a buffer space connected to an application member via a paint flow space through which the paint flows, for buffering pressure fluctuations in the paint flow space by the flow of paint and air between the paint flow space and the buffer space. The pressure fluctuation buffering mechanism includes a buffer space forming member for forming the buffer space. The paint flow space includes: a paint accommodation space for accommodating the paint; and a paint feed space for feeding the paint from the paint accommodation space to the application member. The buffer space forming member includes: an application member-side wall member for forming a wall of the buffer space closer to the application member; a paint accommodation space-side wall member for forming a wall of the buffer space closer to the paint accommodation space; a paint flow channel forming member disposed between the application member-side wall member and the paint accommodation space-side wall member for forming a paint flow channel in the buffer space; and an air flow channel forming member disposed between the application member-side wall member and the paint accommodation space-side wall member for forming an air flow channel in the buffer space. A buffering space communicating with the air flow channel is formed between the paint accommodation space-side wall member and the paint flow channel forming member.

The present invention provides a pressure fluctuation buffering mechanism, including a buffer space connected to an application member via a paint flow space through which the paint flows, for buffering pressure fluctuations in the paint flow space by the flow of paint and air between the paint flow space and the buffer space. The pressure fluctuation buffering mechanism includes: a stopper mechanism for preventing, when the pressure fluctuation buffering mechanism is inserted into a cylinder, prevention of coming off from the cylinder due to its deformation; and an airtight mechanism for providing airtightness to the buffer space. A clearance space is formed between the stopper mechanism and the airtight mechanism, and the airtight mechanism and the stopper mechanism in a deformed state are apart from each other by the clearance space.

There is provided a pressure fluctuation buffering mechanism, including a buffer space connected to an application member via a paint flow space through which the paint flows, for buffering pressure fluctuations in the paint flow space by the flow of paint and air between the paint flow space and the buffer space. The pressure fluctuation buffering mechanism includes an air hole for opening the buffer space to an external space. The air hole directly faces a paint reserving space for reserving the paint.

An applicator of the present invention includes the above-described pressure fluctuation buffering mechanism.

Advantageous Effects of Invention

The present invention can provide a pressure fluctuation buffering mechanism having an extremely high ability to buffer pressure fluctuations and is capable of maintaining its practicality even when applied to a writing instrument, for example, as well as an applicator less likely to generate paint leakage due to pressure fluctuations. Moreover, the present invention can provide a pressure fluctuation buffering mechanism capable of ensuring the flow performance of an ink guiding core and an applicator including such a pressure fluctuation buffering mechanism.

DESCRIPTION OF EMBODIMENTS

An embodiment of the present invention will be described below with reference to the accompanying drawings.

(Applicator)

Figure 1:
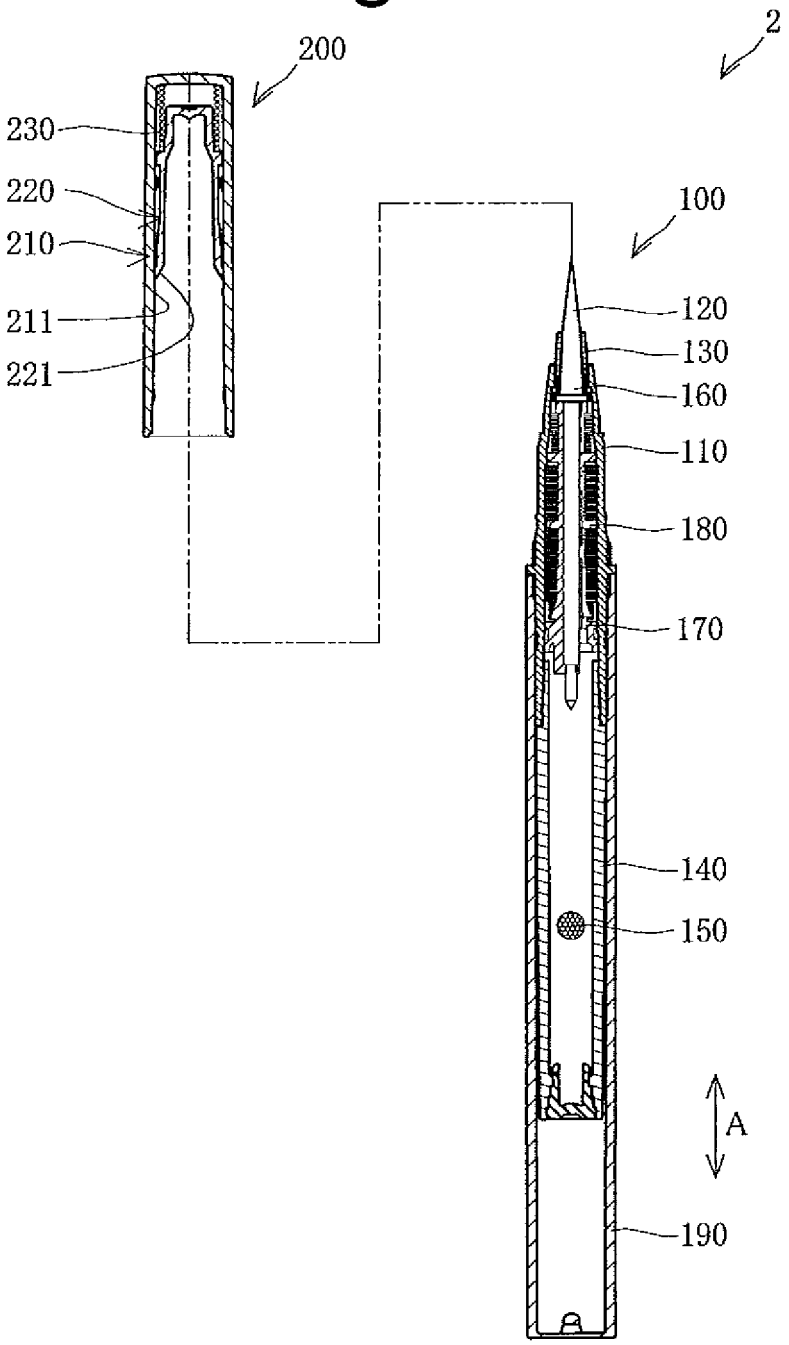
FIG. 1 is a cross-sectional view of an applicator along a plane passing through the center of an inner barrel, illustrating the overview of the applicator.

As shown in FIG. 1, an applicator 2 includes a rod-like applicator body 100 extending lengthwise in a front-rear direction, and a cap 200 detachably provided on a front end portion of the applicator body 100.

(Cap)

The cap 200 includes: an outer cap 210; an inner cap 220 disposed inside the outer cap 210; and an inner cap spring 230 disposed inside the outer cap 210 for biasing the inner cap 220. The outer cap 210 and the inner cap 220 are each made of a synthetic resin such as polypropylene (PP).

An engagement projection 211 is provided on the inner peripheral surface of the outer cap 210. The engagement projection 211 engages with a tip 221 of the inner cap 220. In the internal space of the outer cap 210, the inner cap 220 is movable between an engaged position at which the tip 211 engages with the engagement projection 211 and an unengaged position at which the tip 211 is separated from the engagement projection 211. In the internal space of the outer cap 210, the inner cap spring 230 is disposed between the inner peripheral surface of the outer cap 210 and the outer peripheral surface of the inner cap 220. The inner cap spring 230 biases the inner cap 220 toward the engaged position.

(Applicator Body)

Figure 2:
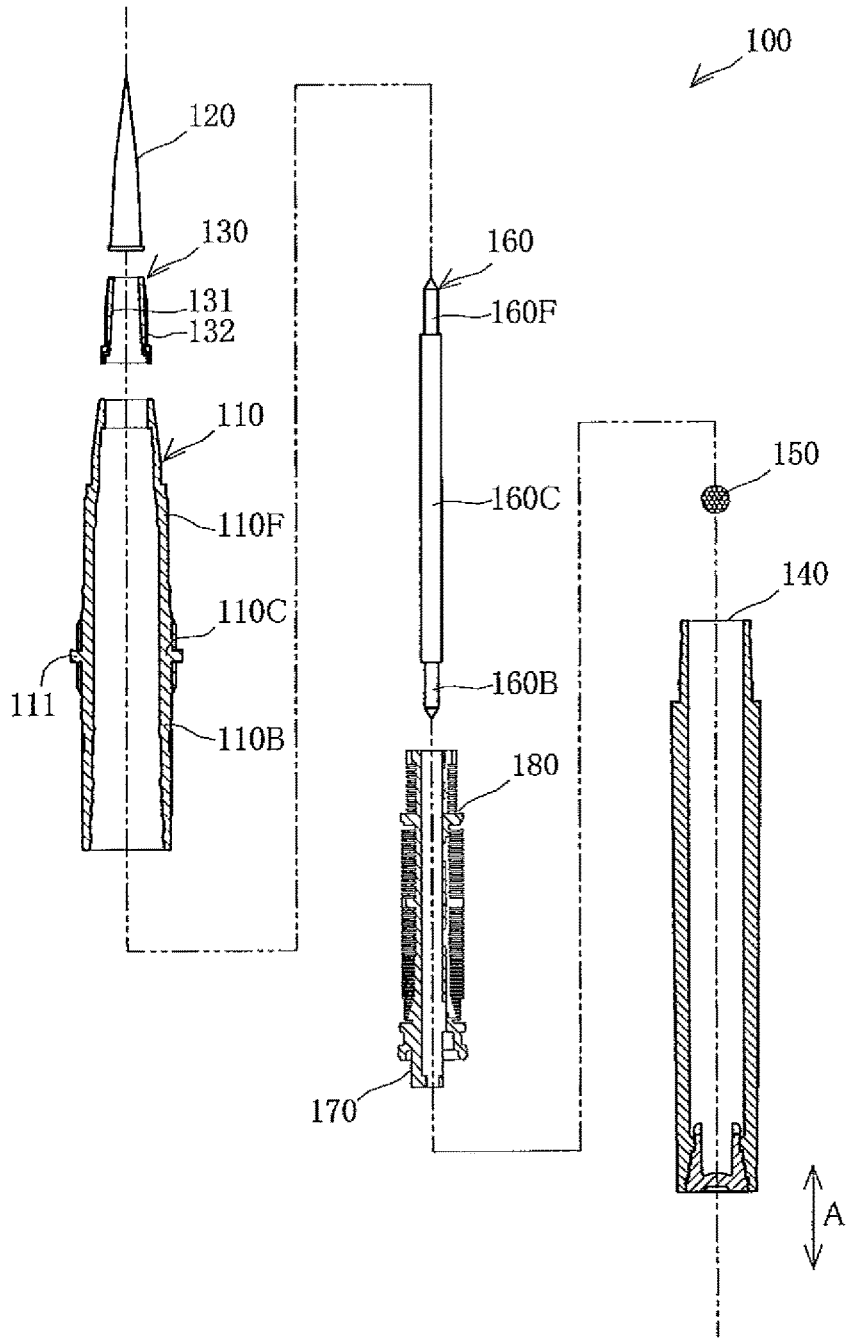
FIG. 2 is an exploded cross-sectional view along the same plane as FIG. 1, illustrating the overview of the applicator.

As shown in FIGS. 1 and 2, the applicator body 100 includes: a cylindrical inner barrel 110; a brush 120 disposed on the front end side of the inner barrel 110; a brush holding member 130 attached to an opening of the inner barrel 110 on its front end side for holding the brush 120; a paint tank 140 attached to an opening of the inner barrel 110 on its rear end side; an agitating member 150 accommodated in the paint tank 140 together with paint; a paint feeder 160 (paint feed core) for feeding the paint accommodated in the paint tank 140 to the brush 120; a paint feeder holding cylinder 170 disposed in the internal space of the inner barrel 110 for holding the paint feeder 160; a pressure fluctuation buffering mechanism 180 for buffering pressure fluctuation in the paint tank 140; and an outer barrel 190 attached to the inner barrel 110 so as to cover the paint tank 140.

(Inner Barrel)

The inner barrel 110 is formed in a cylindrical shape. An engagement projection 111 is formed on the outer peripheral surface of a midway portion 110C of the inner barrel 110 in an axial direction A. The engagement projection 111 engages with an open end of the cap 200 and an open end of the outer barrel 190. A front-side cylindrical portion 110F of the inner barrel 110 has a smaller outer diameter toward the front side thereof, thereby achieving a shape easier to grip with fingers. A rear-side cylindrical portion 110B of the inner barrel 110, on the other hand, has a substantially constant diameter from its front side to its rear side.

(Paint Tank)

The paint tank 140 accommodates paint. Examples of the paint include ink used for writing instruments and liquid eye liners. Examples of the ink used for writing instruments include raw ink (the viscosity thereof is 10 poise or less, for example), gel ink (the viscosity thereof is in a range of 100 poise to 3,000 poise, for example), and high-viscosity ink (the viscosity thereof is in a range of 10,000 poise to 100,000 poise, for example). Examples of the liquid eye liner include oil-based type, water-based film type, and water-based non-film type liquid eye liners.

The paint tank 140 includes: an end cylinder 141 having openings at both sides; and an end cap 142 for closing the opening of the end cylinder 141 on the rear end side. The opening of the end cylinder 141 on the front end side is attached to the opening of the inner barrel 110 on the rear end side. The end cap 142 is detachably attached to the end cylinder 141, thus allowing for paint refill into the paint tank 140 by detachment and attachment operations of the end cap 142.

(Agitating Member)

The agitating member 150 is accommodated in the paint tank 140 together with the paint. Thus, shaking the applicator 2 in the axial direction A can cause the agitation of the paint in the paint tank 140. Note that the agitating member 150 may have any shape such as a spherical body or a polyhedron (for example, a cube or a rectangular solid). The agitating member 150 may be omitted depending on the type of the paint used.

(Brush)

Figure 3:
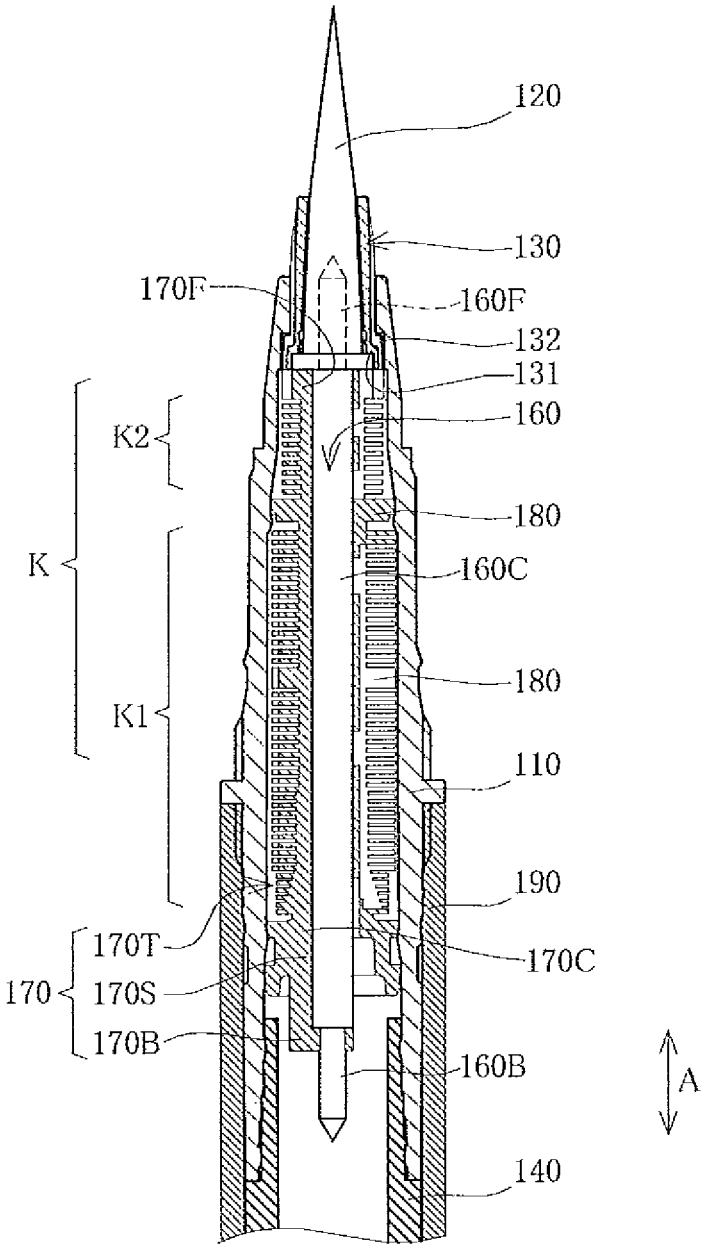
FIG. 3 is a cross-sectional view illustrating the inner barrel of the applicator and the vicinity thereof in an enlarged scale.

As shown in FIGS. 2 and 3, the brush 120 is a mass of fibers made of a synthetic resin such as polybutylene terephthalate (PBT). Although the brush 120 is chosen as an application member to be illustrated, the application member of the present invention may be different from the brush 120 (for example, a ballpoint pen type, felt pen type using the bundle of fibers, plastic pen type having a paint guiding hole therein, or sintered pen type application member, or an application member formed by porous urethane may be used).

(Brush Holding Member)

The brush holding member 130 is formed in a cylindrical shape. The brush holding member 130 includes: a brush engagement portion 131 to engage with the base side of the brush 120 on the inner peripheral surface thereof; and an inner barrel engagement portion 132 to engage with the inner barrel 110 on the outer peripheral surface thereof. This allows the brush holding member 130 to hold the brush 120 on the front end side of the inner barrel 110.

(Paint Feeder)

The paint feeder 160 is formed in a rod shape and extends from the internal space of the paint tank 140 to the brush 120. The paint feeder 160 includes: a middle rod portion 160C; a front rod portion 160F extending from an end of the middle rod portion 160C closer to the brush 120; and a rear rod portion 160B extending from an end of the middle rod portion 160C closer to the paint tank 140. It is preferable that the front rod portion 160F and the rear rod portion 160B have pointed tips. The tip of the front rod portion 160F goes into the brush 120 and the tip of the rear rod portion 160B is exposed in the internal space of the paint tank 140. This allows the paint feeder 160 to feed the paint accommodated in the paint tank 140 to the brush 120. Any type of paint feeder, such as an ink absorber type in which ink is retained in a material such as a sponge, a porous material made of urethane, or a filling material made of a bundle of fibers, or a raw ink type in which ink is directly accommodated in an ink tank, may be used as the paint feeder 160.

(Paint Feeder Holding Cylinder)

As shown in FIGS. 3 and 4A to 4D, the paint feeder holding cylinder 170 extends in the axial direction A of the inner barrel 110. The paint feeder holding cylinder 170 includes: a main body cylindrical portion 170T capable of accommodating the paint feeder 160; an extended portion 170S provided in the main body cylindrical portion 170T; and a locking portion 170B provided in the extended portion 170S. The extended portion 170S extends from a rear end face of the main body cylindrical portion 170T toward the paint tank 140. The locking portion 170B is provided in a rear portion of the extended portion 170S so as to project toward an axis line $AX_{170T}$ of the main body cylindrical portion 170T. The extended portion 170S and the locking portion 170B are preferably positioned in the paint tank 140. The locking portion 170E is provided with a press-fit hole 170BX into which the paint feeder 160 is press-fit. The paint feeder holding cylinder 170 holds the rear rod portion 160B of the paint feeder 160 by the press-fit of the press-fit hole 170BX into the rear rod portion 160B. Part of the rear rod portion 160B held by the paint feeder holding cylinder 170 is preferably positioned in the paint tank 140. Furthermore, such part is preferably exposed in the paint tank 140. Such part exposed in the paint tank 140 allows for the flow of the paint and air with the paint tank 140. The paint feeder holding cylinder 170 is made of polyester, for example.

As described above, the main body cylindrical portion 170T functions as a supporting mechanism of the paint feeder 160 (feed core supporting structure) to accommodate the paint feeder 160. Moreover, the locking portion 170B functions as a locking mechanism of the paint feeder 160 (feed core locking structure) to lock a rear end portion of the paint feeder 160. The extended portion 170S functions as a connecting structure for connecting between the supporting mechanism of the paint feeder 160 and the locking mechanism of the paint feeder 160.

The inner barrel 110, the brush holding member 130, the paint tank 140, and the outer barrel 190 are each made of a synthetic resin such as polypropylene (PP), polyethylene (PE), polyethylene terephthalate (PET), nylon, polyester, or acrylic, for example.

(Pressure Fluctuation Buffering Mechanism)

Figure 4A:
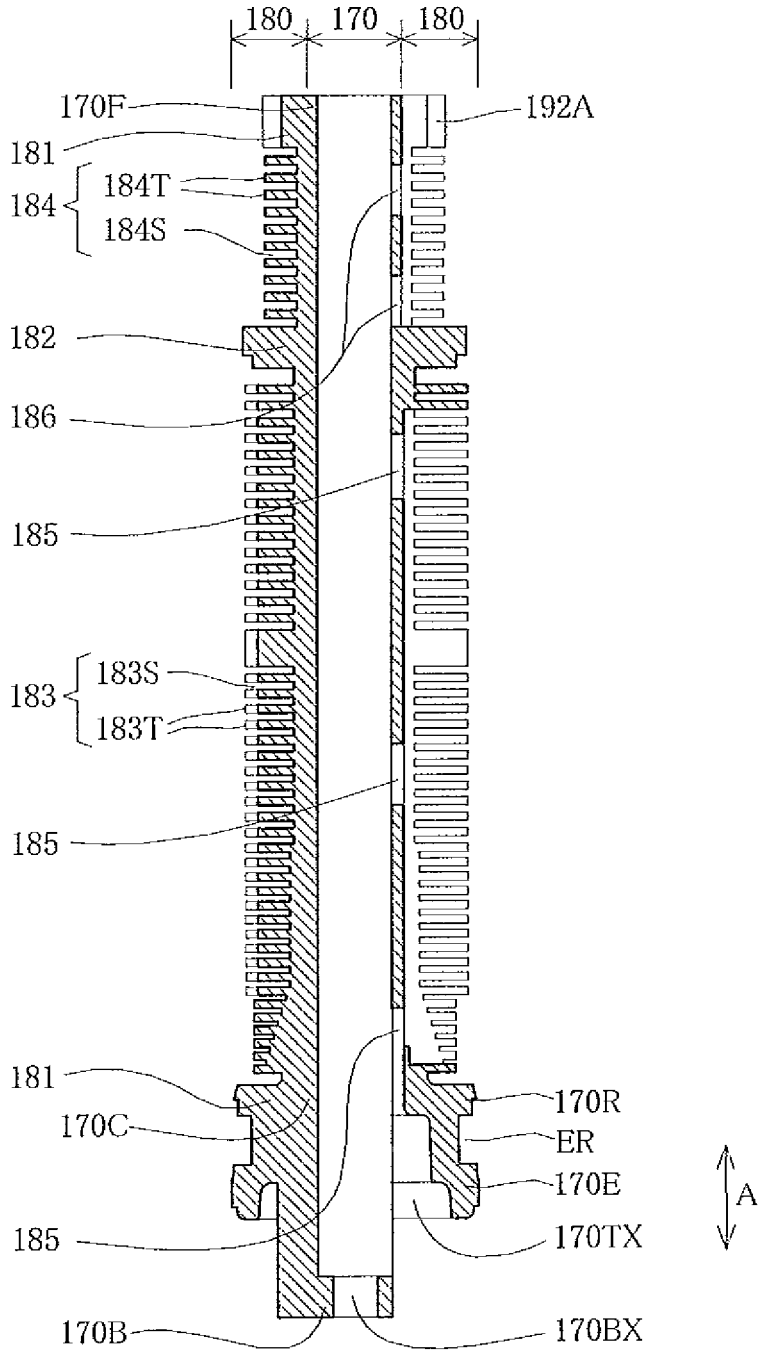
FIG. 4A is a cross-sectional view illustrating the overview of a paint feeder holding cylinder and a pressure fluctuation buffering mechanism.
Figure 4B:
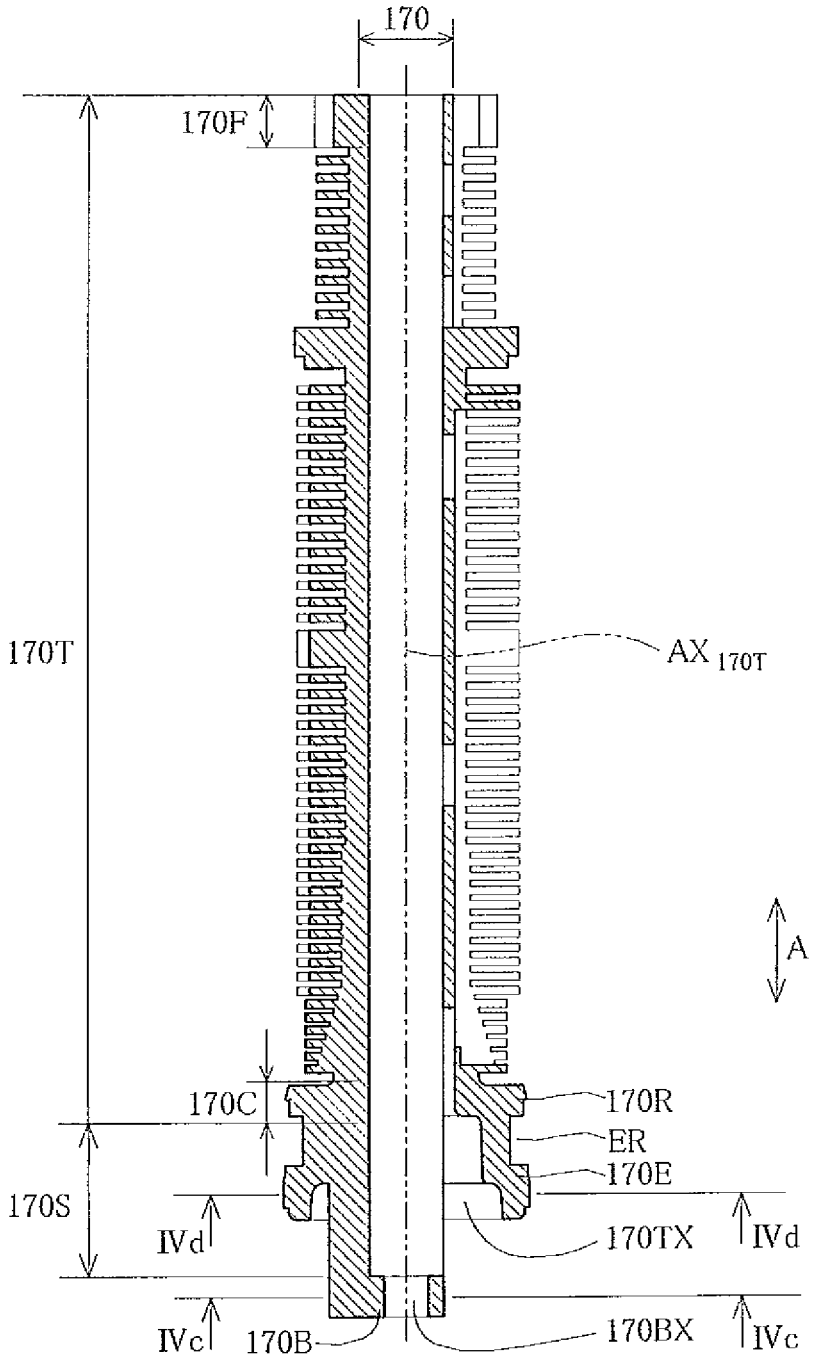
FIG. 4B is a cross-sectional view illustrating the overview of the paint feeder holding cylinder.
Figure 4C:
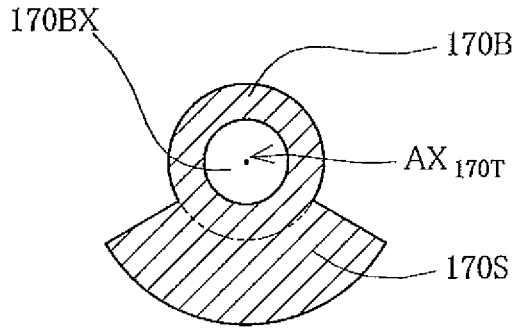
FIG. 4C is a cross-sectional view of the paint feeder holding cylinder taken along line IVc-IVc.
Figure 4D:
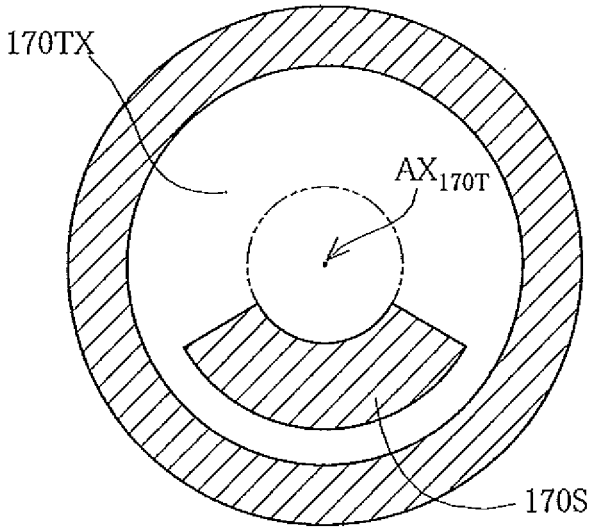
FIG. 4D is a cross-sectional view of the paint feeder holding cylinder taken along line IVd-IVd.
Figure 5:
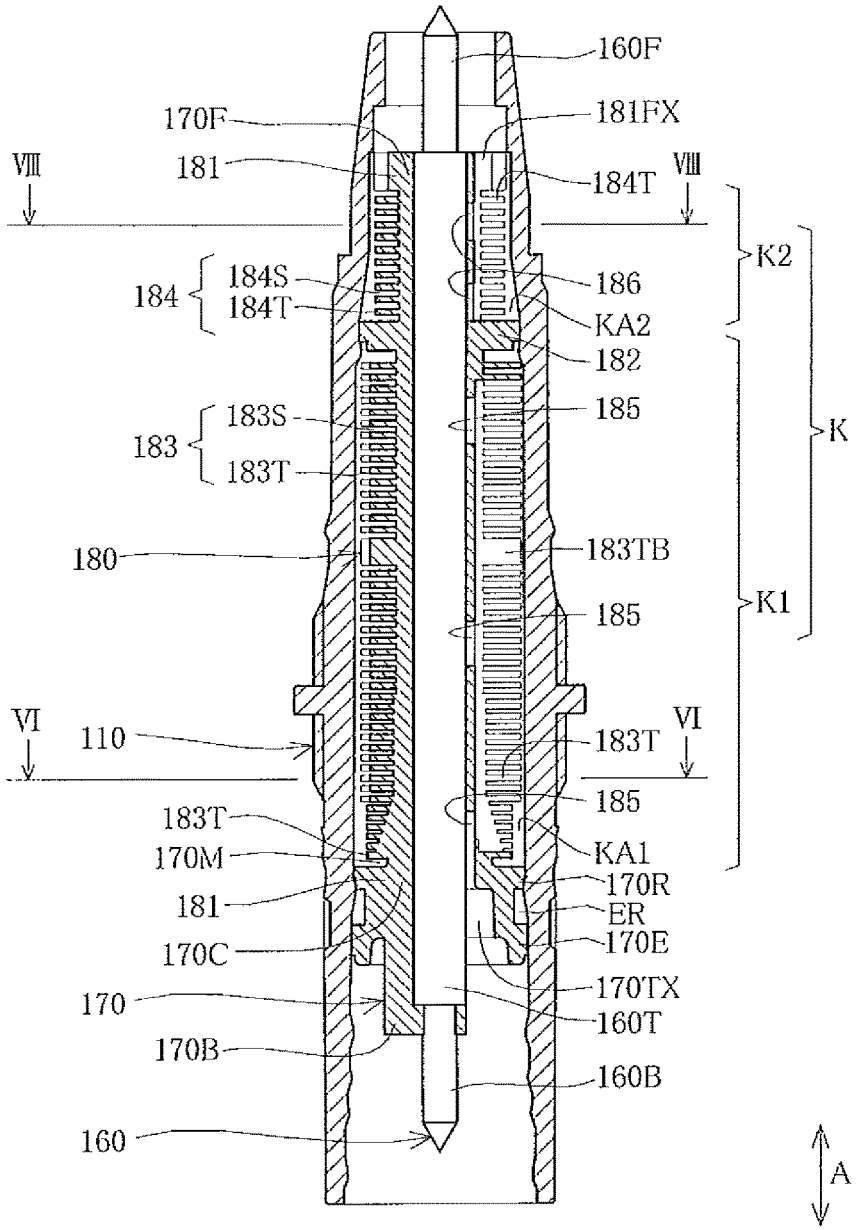
FIG. 5 is a cross-sectional view illustrating the paint feeder holding cylinder, the pressure fluctuation buffering mechanism, and the vicinity thereof in an enlarged scale.

As shown in FIG. 3, the pressure fluctuation buffering mechanism 180 is provided to form a buffer space K directly or indirectly communicating with the paint tank 140. Moreover, the paint feeder holding cylinder 170 and the pressure fluctuation buffering mechanism 180 are integrally formed. As shown in FIGS. 4A, 4B, and 5, the pressure fluctuation buffering mechanism 180 includes: a buffer space forming member 181 to form the buffer space K; a separating member 182 for separating the buffer space K, a first buffer space K1, and a second buffer space K2; a first buffer space forming member 183 for forming the first buffer space K1 having a predetermined channel; a second buffer space forming member 184 for forming the second buffer space K2 having a predetermined channel; a first connection channel 185 for allowing the first buffer space K1 to communicate with the internal space of the paint feeder holding cylinder 170; and a second connection channel 186 for allowing the second buffer space K2 to communicate with the internal space of the paint feeder holding cylinder 170. The first buffer space forming member 183 and the second buffer space forming member 184 individually function as pressure fluctuation buffering structures.

(Buffer Space Forming Member)

The buffer space forming members 181 are arranged in the paint feeder holding cylinder 170 with a predetermined interval therebetween in the axial direction A. For example, one of the buffer space forming members 181 is provided in a front end portion 170F of the paint feeder holding cylinder 170 (a front end portion of the main body cylindrical portion 170T), whereas the other one of the buffer space forming members 181 is provided in a midway portion 170C of the paint feeder holding cylinder 170 (a rear end portion of the main body cylindrical portion 170T). Each buffer space forming member 181 is erected from the outer peripheral surface of the paint feeder holding cylinder 170 and extends toward the inner peripheral surface of the inner barrel 110. In this manner, the buffer space K is formed over an area from the outer peripheral surface of the paint feeder holding cylinder 170 to the inner peripheral surface of the inner barrel 110 between at least the two buffer space forming members 181.

(Separating Member)

The separating member 182 is provided in the paint feeder holding cylinder 170 between the front-side buffer space forming member 181 and the rear-side buffer space forming member 181. The separating member 182 is erected from the outer peripheral surface of the paint feeder holding cylinder 170 and extends toward the inner peripheral surface of the inner barrel 110. The separating member 182 separates the buffer space K into the first buffer space K1 and the second buffer space K2.

(First Buffer Space Forming Member)

Figure 6:
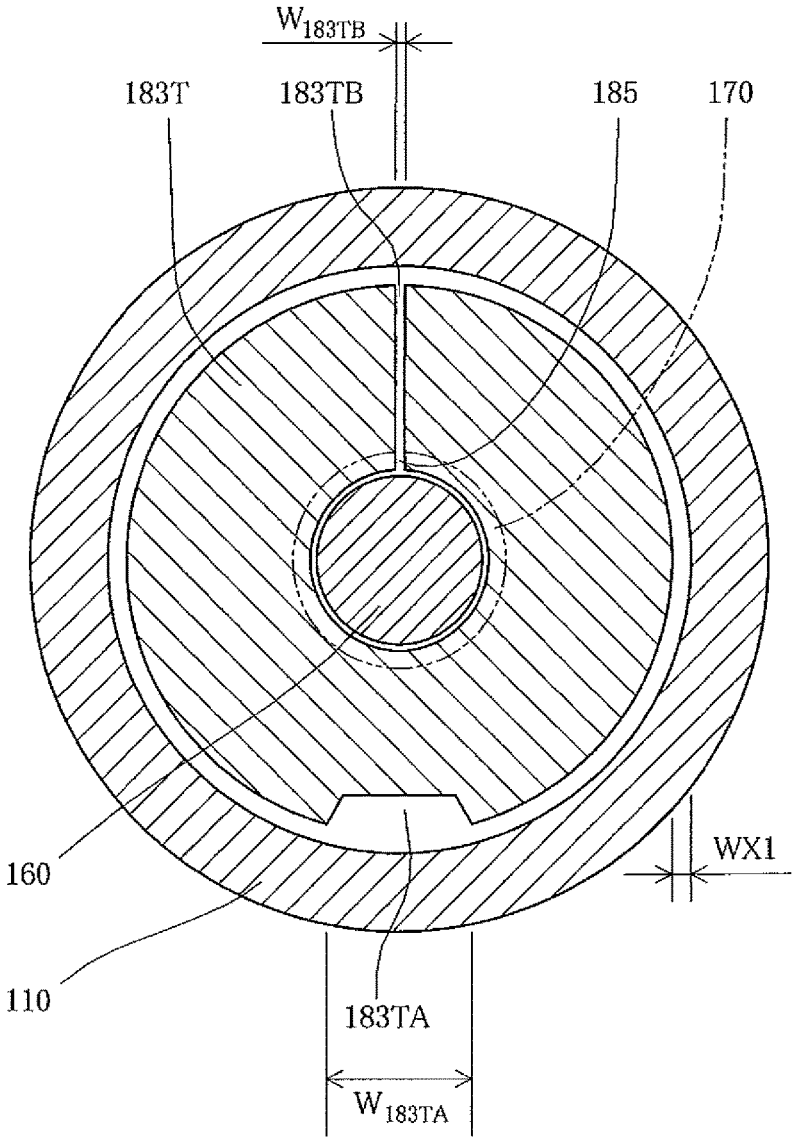
FIG. 6 is a cross-sectional view taken along line VI-VI, illustrating the overview of the paint feeder holding cylinder and the pressure fluctuation buffering mechanism.

As shown in FIGS. 4A and 6, the first buffer space forming member 183 includes a plurality of annular first protruded plates 183T. The plurality of first protruded plates 183T are arranged in the axial direction A at predetermined intervals. Each first protruded plate 183T is erected from the outer peripheral surface of the paint feeder holding cylinder 170 and extends toward the inner peripheral surface of the inner barrel 110. In the first buffer space K1, first circumferential grooves 183S are each formed between two of the plurality of first protruded plates 183T (see FIG. 7A).

As shown in FIG. 6, the plurality of first protruded plates 183T are each provided with an air cutout 183TA and a paint cutout 183TB.

Figure 7A:
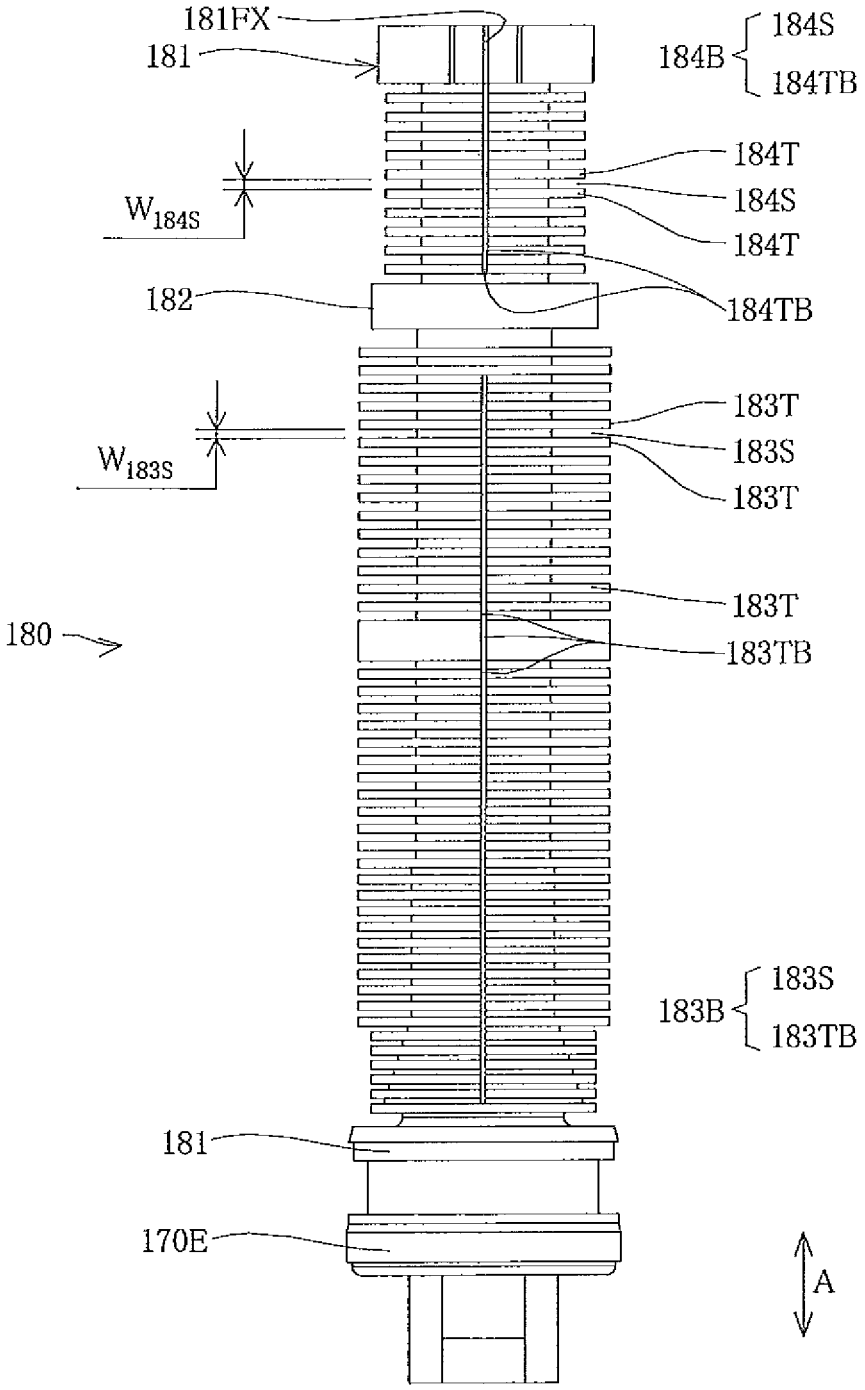
FIG. 7A is a plan view illustrating the overview of a first paint communicating groove and a second paint communicating groove.

As shown in FIG. 7A, the paint cutouts 183TB provided in the plurality of first protruded plates 183T are arranged in the axial direction A. A width $W_{183S}$ of the first circumferential groove 183S and a width $W_{183TB}$ of the paint cutout 183TB (see FIG. 6) are determined so that the paint can flow in to such widths due to capillary force. In other words, the paint cutouts 183TB and portions of the first circumferential grooves 183S each positioned between two of the paint cutouts 183TB function as a first paint communicating groove 183B (first paint flow channel) in the first buffer space K1. Note that the paint preferably flows more easily in the paint cutout 183TB (see FIG. 6) than in the first circumferential groove 183S (see FIG. 7A). Thus, the width $W_{183TB}$ of the paint cutout 183TB (see FIG. 6) is preferably smaller than the width $W_{183S}$ of the first circumferential groove 183S (see FIG. 7A).

Figure 8:
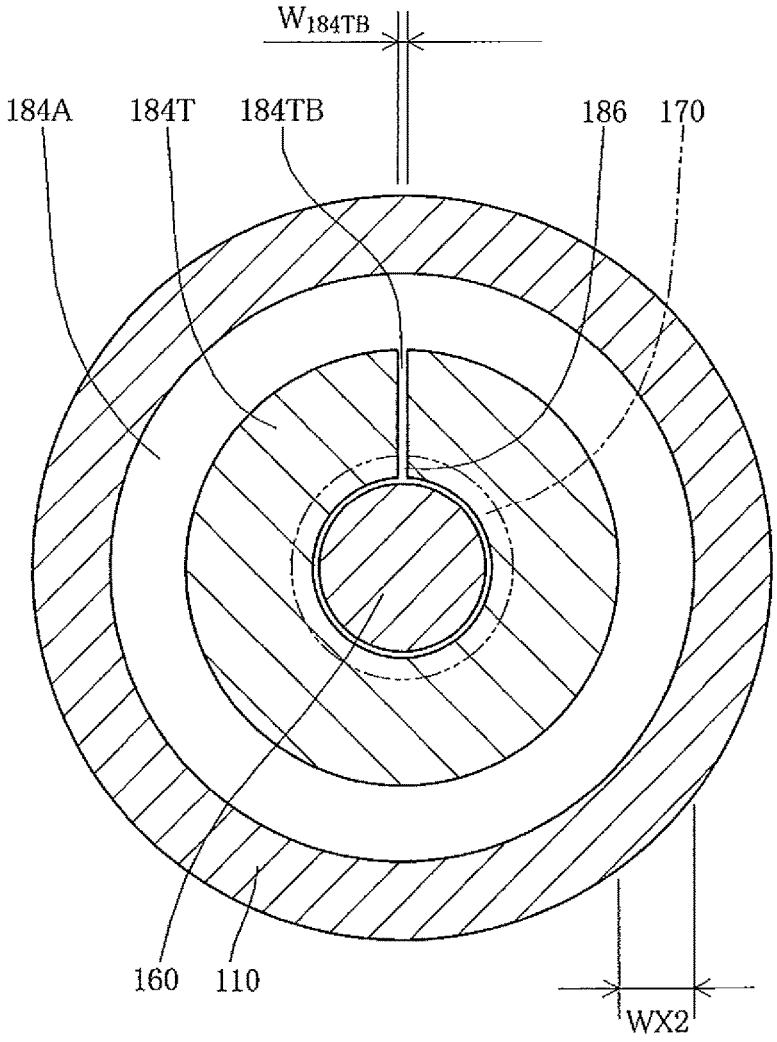
FIG. 8 is a cross-sectional view taken along line VIII-VIII, illustrating the overview of the paint feeder holding cylinder and the pressure fluctuation buffering mechanism.

As shown in FIG. 8, the air cutouts 183TA provided in the plurality of first protruded plates 183T are arranged in the axial direction A in the plurality of first protruded plates 183T. The air cutouts 183TA and portions of the first circumferential grooves 183S are each positioned between two of the air cutouts 183TA and function as a first air longitudinal groove 183A (first air flow channel), i.e., a first air communicating groove in the first buffer space K1. Note that the first air longitudinal groove 183TA is preferably positioned opposite to the first paint communicating groove 183TB (see FIG. 6).

(First Connection Channel)

As shown in FIGS. 5 and 6, the first connection channel 185 is formed so as to penetrate to the inner peripheral surface of the paint feeder holding cylinder 170 from a cutout surface of the paint cutout 183TB. The first connection channel 185 allows for the flow of the paint between the first buffer space K1 and the paint feeder 160 inserted into the paint feeder holding cylinder 170. One or more first connection channels 185 may be provided.

As shown in FIG. 4B, the paint feeder holding cylinder 170 further includes: a stopper portion 170R; an airtight portion 170E; and a paint tank communicating channel 170TX. The stopper portion 170R has a stopper surface to be in intimate contact with the inner peripheral surface of the inner barrel 110. The stopper portion 170R is provided on a peripheral surface of the rear-side buffer space forming member 181. The airtight portion 170E projects from the paint feeder holding cylinder 170 in an area posterior to the rear-side buffer space forming member 181. An airtight surface to be in intimate contact with the inner peripheral surface of the inner barrel 110 is formed at the tip of the airtight portion 170E. One end of the paint tank communicating channel 170TX is opened to the first connection channel 185 and the other end thereof is opened to the paint tank 140. Thus, the first connection channel 185 and the paint tank 140 communicate with each other by the paint tank communicating channel 170TX. Furthermore, the paint tank communicating channel 170TX allows the peripheral surface of the middle rod portion 160C in the paint feeder 160 to be connected to the paint tank 140. Thus, the paint tank communicating channel 170TX allows for the flow of the paint and air between the paint feeder 160 and the paint tank 140. Note that a recess formed on the inner peripheral surface of the paint feeder holding cylinder 170 may be used as the paint tank communicating channel 170TX.

Incidentally, the intimate contact with the inner peripheral surface of the inner barrel 110 causes the stopper portion 170R to deform. Such deformation of the stopper portion 170R contributes to the prevention of the coming off of the stopper portion 170R from the inner barrel 110. When the stopper portion 170R and the airtight portion 170E are integrally formed, however, the deformation of the stopper portion 170R has an adverse effect on airtightness obtained by the airtight portion 170E. To solve such a problem, a clearance void ER may be provided between the stopper portion 170R and the airtight portion 170E (see FIGS. 4A, 4B, and 5). The clearance void ER preferably has a size just enough to avoid contact between the stopper portion 170R deformed by the intimate contact with the inner peripheral surface of the inner barrel 110 and the airtight portion 170E. This ensures airtightness by the airtight portion 170E even when the stopper portion 170R is deformed. In other words, providing the clearance void ER can simultaneously achieve the stopper function and the airtightness.

(Second Buffer Space Forming Member)

Figure 9A:
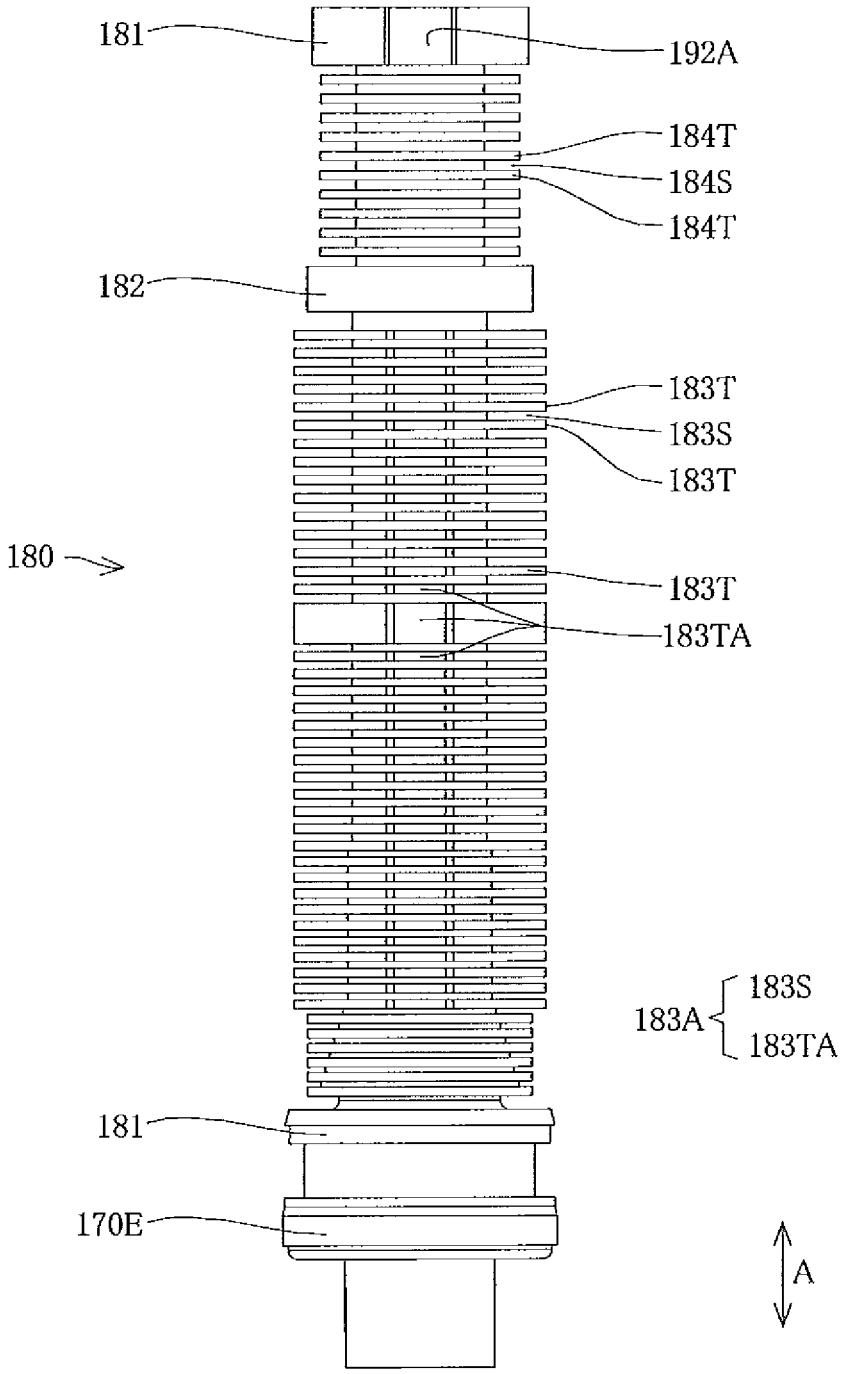
FIG. 9A is a plan view illustrating the overview of a first air communicating groove.

As shown in FIGS. 4 and 8, the second buffer space forming member 184 includes a plurality of annular second protruded plates 184T. The plurality of second protruded plates 184T are arranged in the axial direction A at predetermined intervals. Each second protruded plate 184T is erected from the outer peripheral surface of the paint feeder holding cylinder 170 and extends toward the inner peripheral surface of the inner barrel 110. Second circumferential grooves 184S are thus each formed between two of the plurality of second protruded plates 184T in the second buffer space K2 (see FIG. 9A).

Furthermore, paint cutouts 184TB are provided in the plurality of second protruded plates 184T (see FIG. 8). The paint cutouts 184TB provided in the plurality of second protruded plates 184T are arranged in the axial direction A (see FIG. 7A). A width $W_{184S}$ of the second circumferential groove 184S (see FIG. 7A) and a width $W_{184TB}$ of the paint cutout 184TB (see FIG. 8) are determined so that the paint can flow in to such widths due to the capillary force. In other words, the second circumferential grooves 184S and the paint cutouts 184TB function as a second paint communicating groove 184E (second paint flow channel) in the second buffer space K2. Note that the paint preferably flows more easily in the paint cutout 184TB (see FIG. 8) than in the second circumferential groove 184S (see FIG. 7A). Thus, the width $W_{184TB}$ of the paint cutout 184TB (see FIG. 8) is preferably smaller than the width $W_{184S}$ of the second circumferential groove 184S (see FIG. 7A).

The second paint communicating groove 184B is apart from the first paint communicating groove 183B. The separating member 182 is positioned between the second paint communicating groove 184B and the first paint communicating groove 183B. In other words, the separating member 182 keeps the second paint communicating groove 184B and the first paint communicating groove 183B away from each other.

As shown in FIG. 8, a gap 184A is formed between the tip surface of the second protruded plate 184T and the inner peripheral surface of the inner barrel 110. The gap 184A functions as a second air flow channel in the second buffer space K2.

Figure 9B:
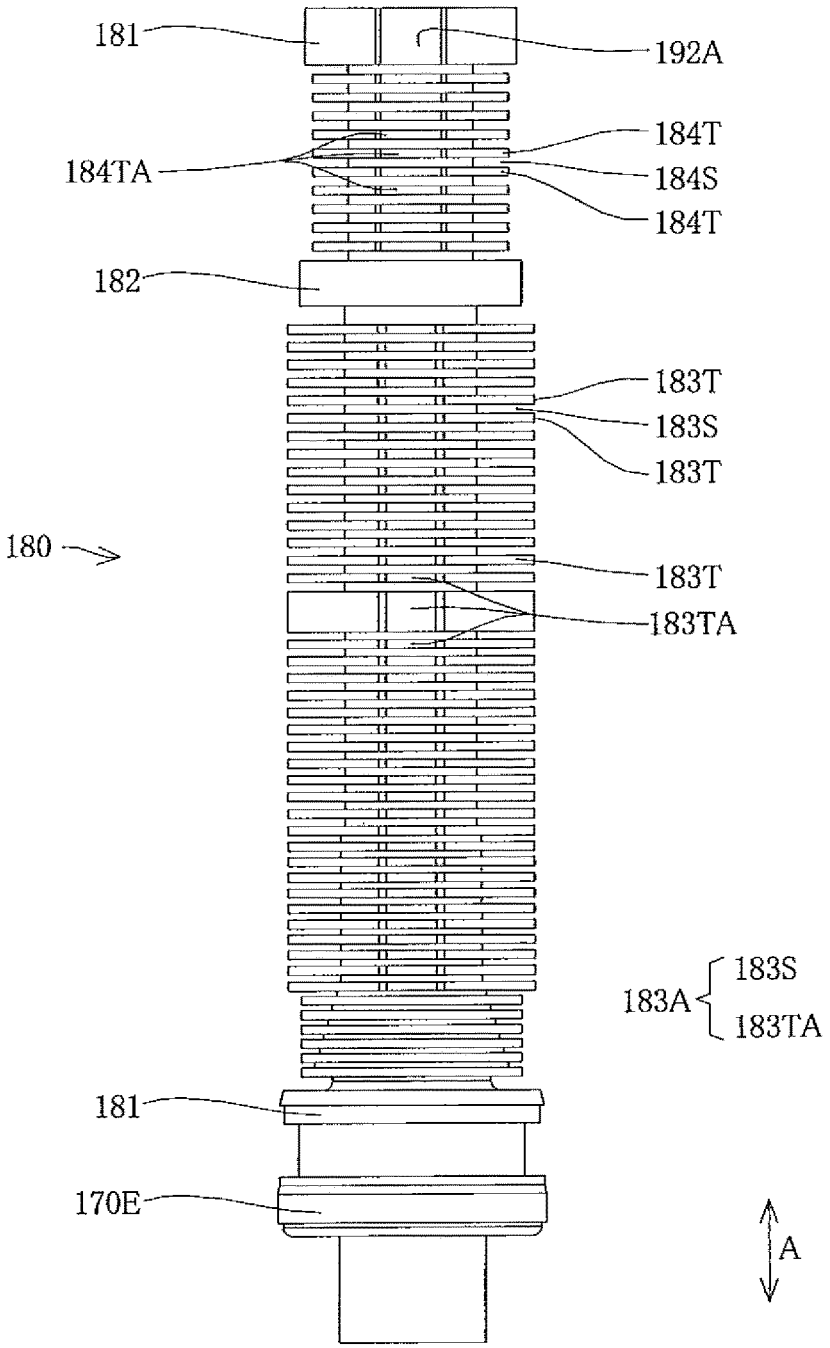
FIG. 9B is a plan view illustrating the overview of the first air communicating groove.

Note that the plurality of second protruded plates 184T may be provided with air cutouts 184TA (see FIG. 9B) as well as the paint cutouts 184TB. As shown in FIG. 9B, the air cutouts 184TA provided in the plurality of second protruded plates 184T are arranged in the axial direction A in the plurality of second protruded plates 184T. The air cutouts 184TA and portions of the second circumferential grooves 184S each are positioned between two of the air cutouts 184TA and thus function as a second air communicating groove in the second buffer space K2.

(Second Connection Channel)

As shown in FIGS. 5 and 8, the second connection channel 186 penetrates to the inner peripheral surface of the paint feeder holding cylinder 170 from a groove surface of the second circumferential groove 184S. The second connection channel 186 allows for the flow of the paint between the second buffer space K2 and the paint feeder 160 inserted into the paint feeder holding cylinder 170. One or more second connection channels 186 may be provided.

As shown in FIG. 7A, the width $W_{183S}$ of the first circumferential groove 183S gradually increases from the rear side toward the front side. Thus, the ease of paint inflow increases from the rear side toward the front side. Similarly, the width $W_{184S}$ of the second circumferential groove 184S gradually increases from the rear side toward the front side. Thus, the ease of paint inflow increases from the rear side toward the front side.

Moreover, the width $W_{183S}$ of the first circumferential groove 183S is smaller than the width $W_{184S}$ of the second circumferential groove 184S. Thus, paint inflow due to the capillary force occurs more easily in the first circumferential groove 183S than in the second circumferential groove 184S.

The paint feeder holding cylinder 170 and the pressure fluctuation buffering mechanism 180 are each made of a synthetic resin. When water paint is used, examples of the synthetic resin preferably used include an ABS resin, an AS resin, a PET resin, a PBT resin, a styrene resin, a POM resin, polycarbonate, polyamide, and modified polyphenylene ether. Alternatively, when oil paint (in particular, paint using alcohol as a prime solvent) is used, examples of the synthetic resin preferably used include a PE resin, a PP resin, a POM resin, a PET resin, a PBT resin, and polyamide.

Functions of the present invention will be described next.

As described above, the width $W_{183S}$ of the first circumferential groove 183S is smaller than the width $W_{184S}$ of the second circumferential groove 184S. Thus, the inflow of the paint occurs easily in the first buffer space K1 prior to the second buffer space K2. The outflow of the paint occurs easily in the second buffer space K2 prior to the first buffer space K1. Thus, when pressure in the paint tank 140 (see FIG. 3) increases, the paint flows in to the first buffer space K1 prior to the second buffer space K2. After a predetermined amount of the paint is filled in the first buffer space K1, the paint starts to flow in to the second buffer space K2. When pressure in the paint tank 140 decreases, on the other hand, the paint flows out from the second buffer space K2 prior to the first buffer space K1. After all paint or almost all paint flows out from the second buffer space K2, the paint starts to flow out from the first buffer space K1. The inflow of the paint to the first buffer space K1 can therefore reduce pressure fluctuations in the paint tank 140. By providing, in the buffer space K, the first buffer space K1 and the second buffer space K2, each having a different ease of paint accumulation, the first buffer space K1 can assume the function of buffering pressure fluctuations in the paint tank 140 under normal use conditions, whereas the second buffer space K2 can assume the function of buffering pressure fluctuations in the paint tank 140 under use conditions different from the normal use conditions.

To make the inflow of the paint due to the capillary force more likely to occur in the first circumferential groove 183S prior to the second circumferential groove 184S, the width $W_{183S}$ of the first circumferential groove 183S is made smaller than the width $W_{184S}$ of the second circumferential groove 184S in the above-described embodiment. However, the present invention is not limited thereto. It is only required that the paint flows more easily in the first buffer space K1 than in the second buffer space K2. A specific example may employ the width $W_{183TB}$ of the paint cutout 183TB smaller than the width $W_{184TB}$ of the paint cutout 184TB, the first buffer space K1 having a higher paint wettability than the second buffer space K2, or a combination of these.

Figure 10:
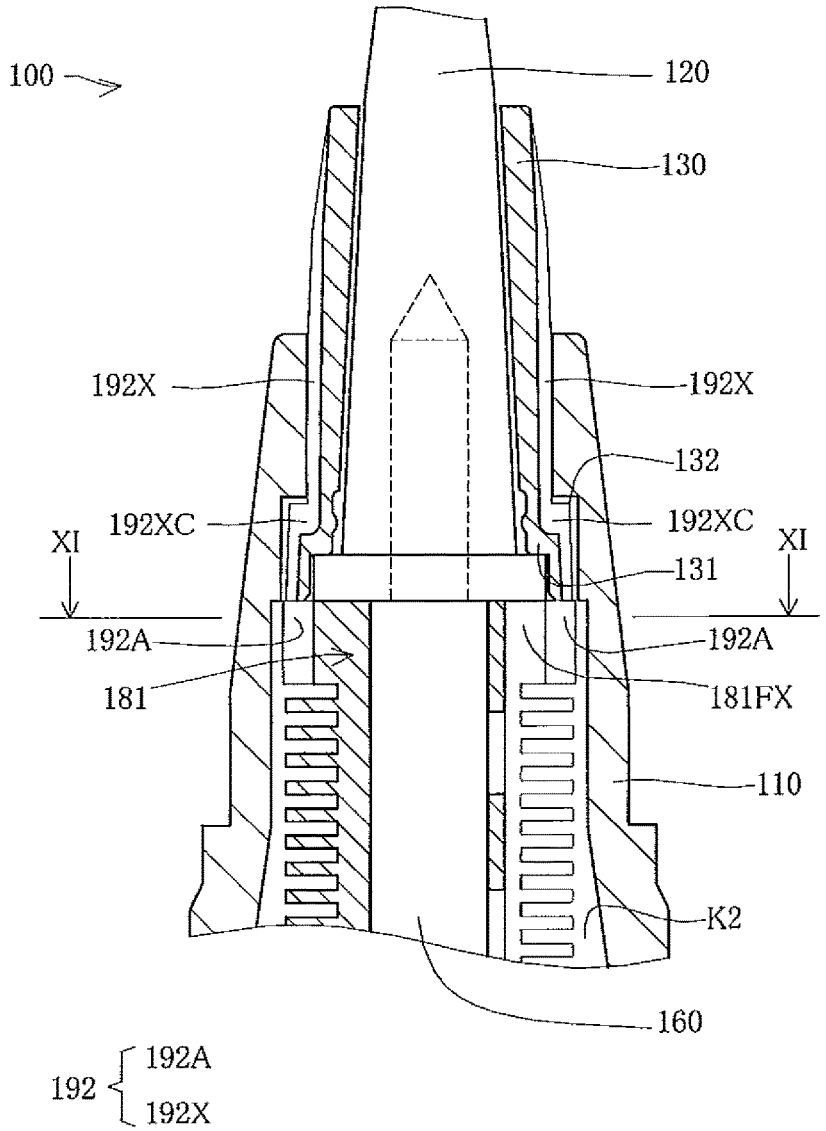
FIG. 10 is a cross-sectional view illustrating a brush, a brush holding member, and the vicinity thereof in an enlarged scale.

As shown in FIGS. 4 and 10, the front-side buffer space forming member 181 is preferably provided with a brush communicating hole 181FX that allows the second buffer space K2 to communicate with the brush 120. In particular, the brush communicating hole 181FX is preferably formed so that the second paint communicating groove 184B (in particular, the paint cutout 184TB) is opened to the brush 120 (see FIGS. 7 and 11). In other words, the opened portion of the second paint communicating groove 184B preferably directly faces the brush 120, and more preferably, is placed close to the brush 120. The formation of the brush communicating hole 181FX causes the second buffer space K2 to be opened to the brush 120. Thus, in both cases where excess paint is in the paint feeder 160 and in the brush 120, such excess paint can be accommodated in the second buffer space K2, i.e., paint leakage can be prevented from occurring. Note that the brush communicating hole 181FX may have any width as long as it can allow for the inflow of the paint due to the capillary force.

Although the separating member 182 separates the buffer space K, the first buffer space K1, and the second buffer space K2 in the above-described embodiment, the present invention is not limited thereto. Any separating structure capable of separating the buffer space K into the first buffer space K1 and the second buffer space K2 may be employed.

Figure 7B:
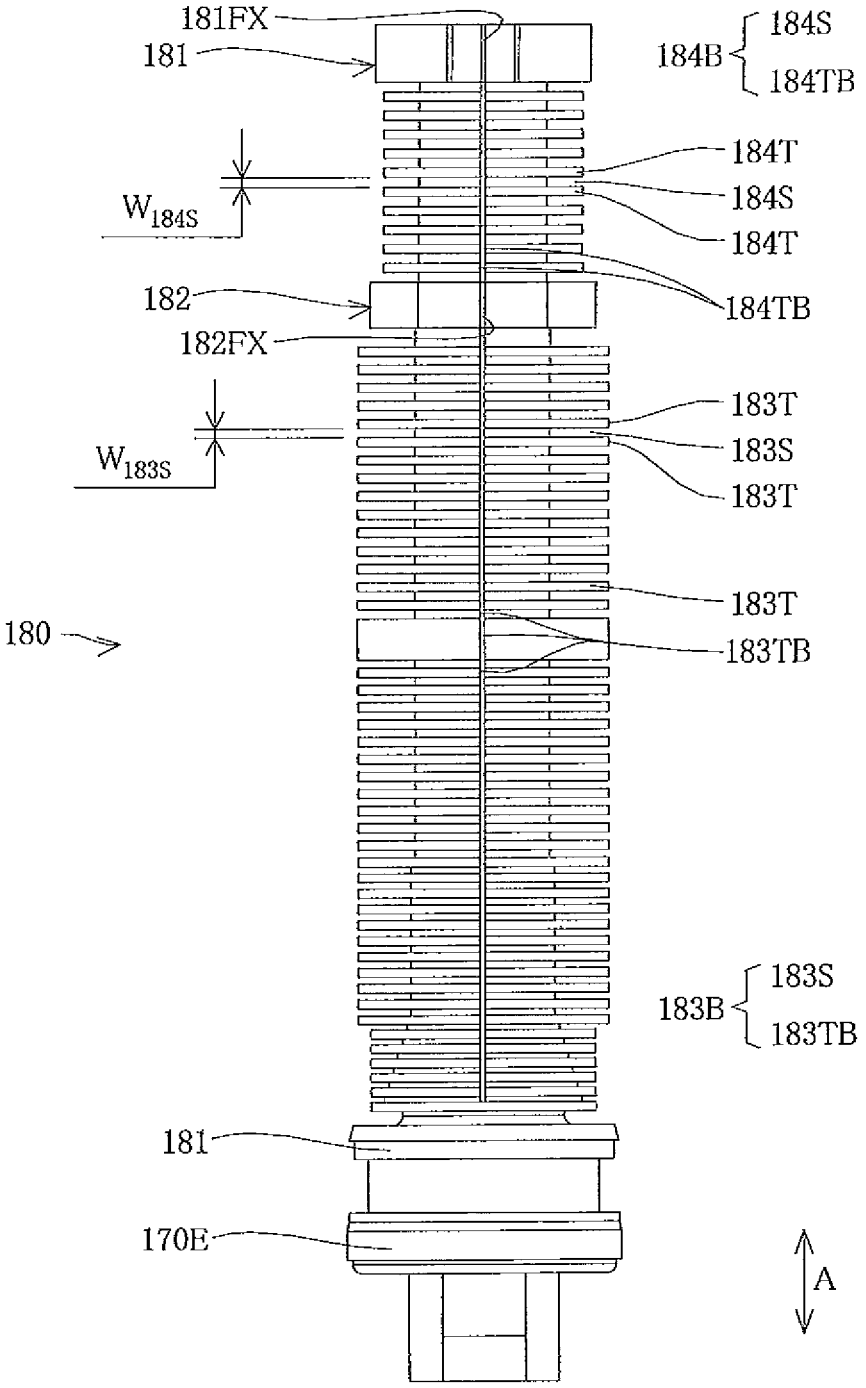
FIG. 7B is a plan view illustrating the overview of the first paint communicating groove and the second paint communicating groove.

As shown in FIG. 5, although the separating member 182 itself has no paint flow channel to which the paint can flow in due to the capillary force in the above-described embodiment, the present invention is not limited thereto. As shown in FIG. 7B, the separating member 182 may have a slit 182FX into which the paint can flow in due to the capillary force. The slit 182FX causes the first buffer space K1 to communicate with the second buffer space K2. Moreover, the slit 182FX is preferably provided at a position directly facing the first paint communicating groove 183B and the second paint communicating groove 184B. Furthermore, as illustrated in the figure, the slit 182FX, the first paint communicating groove 183B, and the second paint communicating groove 184B are preferably formed on the same straight line. Additionally, the width $W_{183TB}$ of the paint cutout 183TB (see FIG. 6) is preferably smaller than the width $W_{184TB}$ of the paint cutout 184TB (see FIG. 8). In this manner, the ease of paint flow in the paint flow channel and the connection channel can be adjusted by the widths of the paint flow channel and the connection channel, or paint wettability in members that form the paint flow channel and the connection channel (referred to collectively as channel forming members). Such paint wettability can be adjusted, for example, by the surface tension of paint, the surface roughness of the channel forming member, or hydrophilic treatment or hydrophobic treatment applied to a surface of the channel forming member. For example, for water paint, the hydrophilic treatment applied to the surfaces of the channel forming members can improve the ease of paint flow in the paint flow channel and the connection channel.

One example of such a separating structure is a structure in which the front-end-side opening of the first paint communicating groove 183B in the first buffer space K1 is apart from the rear-end-side opening of the second paint communicating groove 184B in the second buffer space K2. An interval between these two openings may be just enough to prevent the generation of the capillary force between the two openings. Moreover, the positional relationship between these two openings may be either a positional relationship directly facing each other in the axial direction A or a positional relationship departed therefrom. Furthermore, when the interval between these two openings is just enough to prevent the generation of the capillary force between the two openings, the separating member 182 may be omitted.

Note that a gap (hereinafter referred to as a first gap) WX1 between the tip surface (outer peripheral surface) of the first protruded plate 183T and the inner peripheral surface of the inner barrel 110 is preferably larger than the width $W_{183TB}$ of the paint cutout 183TB as shown in FIG. 6. Similarly, a gap (hereinafter referred to as a second gap) WX2 between the tip surface (outer peripheral surface) of the second protruded plate 183T and the inner peripheral surface of the inner barrel 110 is preferably larger than the width $W_{184TB}$ of the paint cutout 184TB (see FIG. 8). This makes paint flow in the first gap WX1 and the second gap WX2 less likely to occur prior to the paint cutout 183TB and the paint cutout 184TB. Thus, "paint leakage" which will be caused by paint flow along the inner peripheral surface of the inner barrel 110 can be prevented from occurring.

Note that the second gap WX2 is preferably larger than the first gap WX1. In such a case, paint flow is reduced in the second buffer space K2 as compared to the first buffer space K1.

Figure 12:
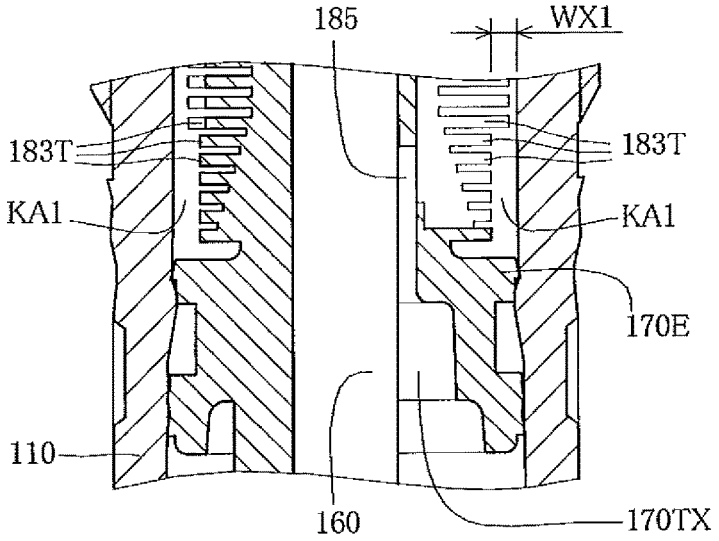
FIG. 12(A) is an explanatory drawing illustrating the overview of an air reservoir formed in a first buffer space.
FIG. 12(B) is an explanatory drawing illustrating the overview of an air reservoir formed in a second buffer space.
Figure 12:
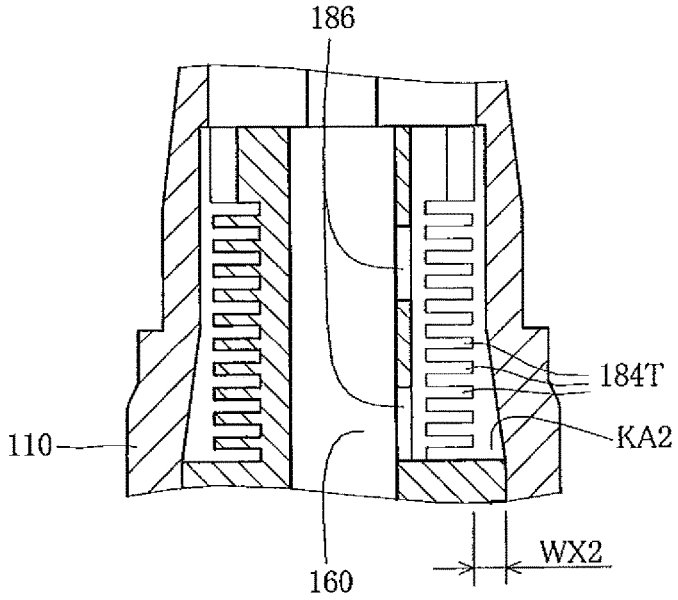

Incidentally, when the pressure is increased in the paint tank 140, the paint flows in to the first connection channel 185 and the first circumferential groove 183S. When such an increase in pressure is rapid, however, the paint may be attached to an inner wall of the inner barrel 110 via the first connection channel 185 and the first circumferential groove 183S. The paint attached to the inner wall of the inner barrel 110 flows along the inner wall, thus leading to the paint leakage. To prevent such paint leakage, an air reservoir KA1 is preferably formed in the first buffer space K1 as shown in FIG. 12(A). To form the air reservoir KA1, the height of the first protruded plate 183T may be reduced to increase the first gap WX1, for example. The air reservoir KA1 is preferably provided at a position opposed to the first connection channel 185 via the first paint communicating groove 183B. Similarly, an air reservoir K2 similar to the air reservoir KA1 may be provided in the second buffer space K2 (see FIG. 12(B)). The first connection channel 185 opposed to the air reservoir KA1 via the first paint communicating groove 183B preferably serves as the flow channel for the paint and also as the flow channel for air. Similarly, the second connection channel 186 opposed to the air reservoir KA2 via the second paint communicating groove 184B preferably serves as the flow channel for the paint and also as the flow channel for air.

Figure 11:
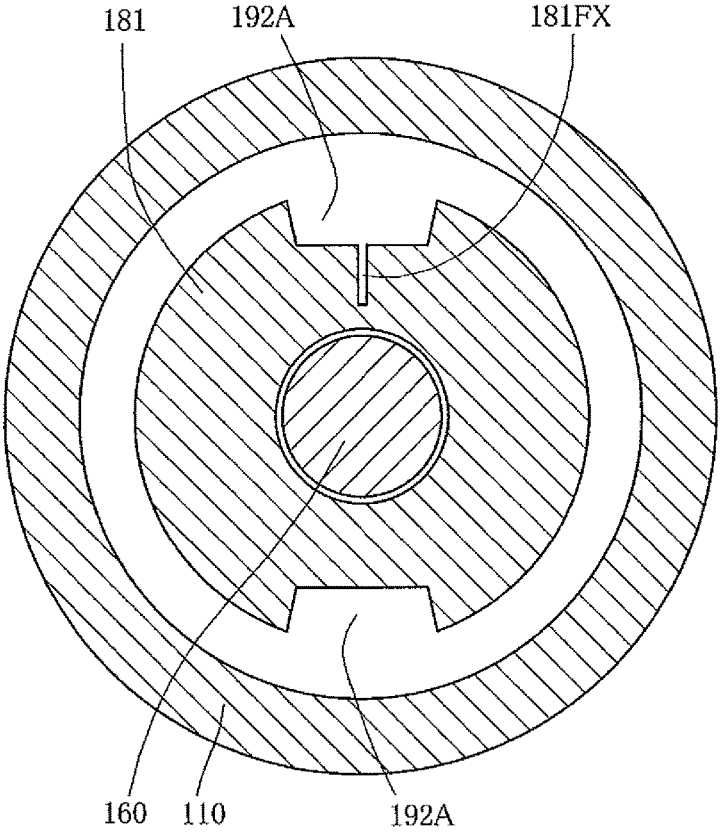
FIG. 11 is a cross-sectional view taken along line XI-XI, illustrating the overview of the paint feeder holding cylinder and the pressure fluctuation buffering mechanism.

As shown in FIGS. 10 and 11, the applicator body 100 may include an external connection mechanism 192 for connecting the second buffer space K2 to the external space. The external connection mechanism 192 includes: a connection hole 192A formed in the front-side buffer space forming member 181; and a front end gap 192X between the inner barrel 110 and the brush holding member 130. The connection hole 192A connects between the front end gap 192X and the second buffer space K2. Since the front end gap 192X is opened to the external space, the second buffer space K2 is connected to the external space via the connection hole 192A and the front end gap 192X.

Here, the front end gap 192X preferably has a crank structure 192XC capable of reserving the paint. The paint having flowed to the connection hole 192A from the second buffer space K2 can be retained by the crank structure 192XC while air flow between the second buffer space K2 and the external space is maintained by the crank structure 192XC.

Although the crank structure 192XC is used as a paint reserving portion for reserving the paint, the present invention is not limited thereto. Any structure capable of reserving the paint may be used.

Incidentally, when the cap 200 is attached to the applicator body 100 as shown in FIG. 1, air around the applicator body 100 may be forced into the second buffer space K2 through the front end gap 192X. Such air around the applicator body 100 forced into the second buffer space K2 increases pressure in the paint tank 140, thus resulting in the leakage of the paint from the brush 120.

The cap 200 of the applicator 2 includes the inner cap 220 and the inner cap spring 230. Thus, when the cap 200 is attached to the applicator body 100, the inner cap 220 transitions from an unengaged state to an engaged state while resisting the biasing force of the inner cap spring 230. Thus, a pressure increase in the paint tank 140 can be made gradual in an attachment operation of the cap 200. This can prevent paint leakage due to the attachment operation of the cap 200.

As shown in FIG. 5, the paint feeder holding cylinder 170, on the other hand, includes the first buffer space forming member 183 and the second buffer space forming member 184 between the front end portion 170F and the midway portion 170C and includes the locking portion 170B in the rear end portion thereof. Here, when the paint feeder 160 is inserted into the main body cylindrical portion 170T, the portion of the paint feeder 160 pressed into the press-fit hole 170BX is compressed, thus having disturbed paint flow as compared to the other portions. Since the locking portion 170B is apart from the main body cylindrical portion 170T in the present invention, even the locking by the locking portion 170B can ensure the paint flow in the paint feeder 160.

The paint feeder holding cylinder 170 includes the paint tank communicating channel 170TX. The paint tank communicating channel 170TX allows for the flow of the paint and air between the paint feeder 160 and the paint tank 140. Therefore, part of the rear rod portion 160B held by the paint feeder holding cylinder 170 is preferably positioned in the paint tank 140. Furthermore, this part is preferably exposed in the paint tank 140. The flow of the paint and air occurs between the part exposed in the paint tank 140 and the paint tank 140 without the intervention of the pressure fluctuation buffering mechanism. In this manner, since the present invention can facilitate the flow of the paint and air between the paint tank 140 and the paint feeder 160, the desired pressure fluctuation buffering function can be exerted.

Figure 4E:
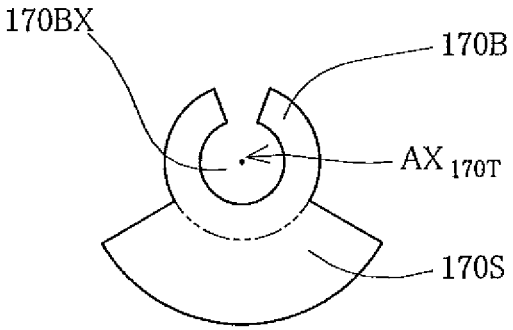
FIG. 4E is a cross-sectional view of the paint feeder holding cylinder taken along line IVc-IVc.

Although the locking portion 170B (see FIGS. 4A to 4D) having the press-fit hole 170BX is employed in the above-described embodiment as the locking structure for the paint feeder 160, the present invention is not limited thereto. The locking portion 170B having a press-fit recess 170BY as shown in FIG. 4E may be employed. Furthermore, a locking portion having a weld portion to be welded with the rear rod portion 160B of the paint feeder 160, or a locking portion having a fit portion to be fit to the rear rod portion 160B of the paint feeder 160 may be employed as a locking structure for the paint feeder 160. Here, when the weld or the fit is employed, instead of the press-fit, as the locking structure for the paint feeder 160, the weld portion of the paint feeder 160 is melted or the fit portion is compressed. Consequently, the paint flow is disturbed as with the case of the press-fit. According to the present invention, however, the paint flow in the paint feeder 160 can be ensured as with the case of the press-fit.

Moreover, the width $W_{183S}$ of the first circumferential groove 183S is smaller than the width $W_{184S}$ of the second circumferential groove 184S. Thus, the inflow of the paint occurs easily in the first buffer space K1 prior to the second buffer space K2. The outflow of the paint occurs easily in the second buffer space K2 prior to the first buffer space K1. Thus, when the pressure in the paint tank 140 (see FIG. 3) increases, the paint flows in to the first buffer space K1 prior to the second buffer space K2. After a predetermined amount of the paint is filled in the first buffer space K1, the paint starts to flow in to the second buffer space K2. When the pressure in the paint tank 140 decreases, on the other hand, the paint flows out from the second buffer space K2 prior to the first buffer space K1. After all paint or almost all paint flows out from the second buffer space K2, the paint starts to flow out from the first buffer space K1. The inflow of the paint to the first buffer space K1 can therefore reduce pressure fluctuations in the paint tank 140. By providing, in the buffer space K, the first buffer space K1 and the second buffer space K2, each having a different ease of paint accumulation, the first buffer space K1 can assume the function of buffering pressure fluctuations in the paint tank 140 under normal use conditions, whereas the second buffer space K2 can assume the function of buffering pressure fluctuations in the paint tank 140 under use conditions different from the normal use conditions.

To make the inflow of the paint due to the capillary force more likely to occur in the first circumferential groove 183S prior to the second circumferential groove 184S, the width $W_{183S}$ of the first circumferential groove 183S is made smaller than the width $W_{184S}$ of the second circumferential groove 184S in the above-described embodiment. However, the present invention is not limited thereto. It is only required that the paint flows more easily in the first buffer space K1 than in the second buffer space K2. A specific example may employ the width $W_{183TB}$ of the paint cutout 183TB being smaller than the width $W_{184TB}$ of the paint cutout 184TB, the first buffer space K1 having a higher paint wettability than the second buffer space K2, or a combination of these.

As shown in FIGS. 4A and 10, the front-side buffer space forming member 181 is preferably provided with the brush communicating hole 181FX that allows the second buffer space K2 to communicate with the brush 120. In particular, the brush communicating hole 181FX is preferably formed so that the second paint communicating groove 184B (in particular, the paint cutout 184TB) is opened to the brush 120 (see FIGS. 7 and 11). In other words, the opened portion of the second paint communicating groove 184B preferably directly faces the brush 120, and more preferably, is placed close to the brush 120. The formation of the brush communicating hole 181FX causes the second buffer space K2 to be opened to the brush 120. Thus, in both cases where excess paint is in the paint feeder 160 and in the brush 120, the excess paint can be accommodated in the second buffer space K2, i.e., paint leakage can be prevented from occurring. Note that the brush communicating hole 181FX may have any width as long as it can allow for the inflow of the paint due to the capillary force.

Although the separating member 182 separates the buffer space K, the first buffer space K1, and the second buffer space K2 in the above-described embodiment, the present invention is not limited thereto. Any separating structure capable of separating the buffer space K into the first buffer space K1 and the second buffer space K2 may be employed.

Although the separating member 182 is used in the above-described embodiment to separate the buffer space K, the first buffer space K1, and the second buffer space K2, the present invention is not limited thereto. The separating member 182 may be omitted to provide a paint flow channel and an air flow channel in one buffer space K.

As shown in FIG. 5, although the separating member 182 itself has no paint flow channel into which the paint can flow in due to the capillary force in the above-described embodiment, the present invention is not limited thereto. As shown in FIG. 7B, the separating member 182 may have the slit 182FX into which the paint can flow in due to the capillary force. The slit 182FX causes the first buffer space K1 to communicate with the second buffer space K2. Moreover, the slit 182FX is preferably provided at a position directly facing the first paint communicating groove 183B and the second paint communicating groove 184B. Furthermore, as illustrated in the figure, the slit 182FX, the first paint communicating groove 183B, and the second paint communicating groove 184B are preferably formed on the same straight line. Additionally, the width $W_{183TB}$ of the paint cutout 183TB (see FIG. 6) is preferably smaller than the width $W_{184TB}$ of the paint cutout 184TB (see FIG. 8).

One example of such a separating structure is the structure in which the front-end-side opening of the first paint communicating groove 183B in the first buffer space K1 is apart from the rear-end-side opening of the second paint communicating groove 184B in the second buffer space K2. The interval between these two openings may be just enough to prevent the generation of the capillary force between the two openings. Moreover, the positional relationship between these two openings may be either a positional relationship directly facing each other in the axial direction A or a positional relationship departed therefrom. Furthermore, when the interval between these two openings is just enough to prevent the generation of the capillary force between the two openings, the separating member 182 may be omitted.

Note that the gap (hereinafter referred to as the first gap) WX1 between the tip surface (outer peripheral surface) of the first protruded plate 183T and the inner peripheral surface of the inner barrel 110 is preferably larger than the width $W_{183TB}$ of the paint cutout 183TB as shown in FIG. 6. Similarly, the gap (hereinafter referred to as the second gap) WX2 between the tip surface (outer peripheral surface) of the second protruded plate 183T and the inner peripheral surface of the inner barrel 110 is preferably larger than the width $W_{184TB}$ of the paint cutout 184TB (see FIG. 8). This makes paint flow in the first gap WX1 and the second gap WX2 less likely to occur prior to the paint cutout 183TB and the paint cutout 184TB. Thus, "paint leakage" which will be caused by paint flow along the inner peripheral surface of the inner barrel 110 can be prevented from occurring.

Note that the second gap WX2 is preferably larger than the first gap WX1. In such a case, paint flow is reduced in the second buffer space K2 as compared to the first buffer space K1.

Incidentally, when the pressure is increased in the paint tank 140, the paint flows in to the first connection channel 185 and the first circumferential groove 183S. When such an increase in the pressure is rapid, however, the paint may be attached to the inner wall of the inner barrel 110 via the first connection channel 185 and the first circumferential groove 183S. The paint attached to the inner wall of the inner barrel 110 flows along the inner wall, thus leading to the paint leakage. To prevent this paint leakage, the air reservoir KA1 is preferably formed in the first buffer space K1 as shown in FIG. 12(A). To form the air reservoir KA1, the height of the first protruded plate 183T may be reduced to increase the first gap WX1, for example. The air reservoir KA1 is preferably provided at a position opposed to the first connection channel 185 via the first paint communicating groove 183B. Similarly, the air reservoir K2 similar to the air reservoir KA1 may be provided in the second buffer space K2 (see FIG. 12(B)). The first connection channel 185 opposed to the air reservoir KA1 via the first paint communicating groove 183B preferably serves as the flow channel for the paint and also as the flow channel for air.

As shown in FIGS. 10 and 11, the applicator body 100 may include the external connection mechanism 192 for connecting the second buffer space K2 to the external space. The external connection mechanism 192 includes: the connection hole 192A formed in the front-side buffer space forming member 181; and the front end gap 192X between the inner barrel 110 and the brush holding member 130. The connection hole 192A connects between the front end gap 192X and the second buffer space K2. Since the front end gap 192X is opened to the external space, the second buffer space K2 is connected to the external space via the connection hole 192A and the front end gap 192X.

Here, the front end gap 192X preferably has the crank structure 192XC capable of reserving the paint. The paint having flowed to the connection hole 192A from the second buffer space K2 can be retained by the crank structure 192XC while air flow between the second buffer space K2 and the external space is maintained by the crank structure 192XC.

Although the crank structure 192XC is used as the paint reserving portion for reserving the paint, the present invention is not limited thereto. Any structure capable of reserving the paint may be used.

Incidentally, when the cap 200 is attached to the applicator body 100 as shown in FIG. 1, air around the applicator body 100 may be forced into the second buffer space K2 through the front end gap 192X. Such air around the applicator body 100 forced into the second buffer space K2 increases the pressure in the paint tank 140, thus resulting in the leakage of the paint from the brush 120.

The cap 200 of the applicator 2 includes the inner cap 220 and the inner cap spring 230. Thus, when the cap 200 is attached to the applicator body 100, the inner cap 220 transitions from the unengaged state to the engaged state while resisting the biasing force of the inner cap spring 230.

Thus, a pressure increase in the paint tank 140 can be made gradual in the attachment operation of the cap 200. This can prevent paint leakage due to the attachment operation of the cap 200.

Furthermore, a buffer groove 170M is formed between the rear-side buffer space forming member 181 and the first protruded plate 183T as shown in FIG. 5. The buffer groove 170M communicates with the first buffer space K1 not via the first paint flow channel but via the first air flow channel. Here, the buffer groove 170M preferably communicates with the second buffer space K2 via the air reservoir KA1. Such a buffer groove 170M functions as a buffering space for buffering pressure fluctuations due to the attachment operation of the cap 200.

The applicator of the present invention may be any of writing instruments (for example, ink pens, calligraphy pens, fountain pens, and the like) and makeup tools as long as it can apply paint to a predetermined object.

Incidentally, for fountain pens, there is no paint feeder 160 (see FIG. 2), and the first paint flow channel and the second paint flow channel also serve as the paint feeder. In other words, for the fountain pens, the first buffer space such as the first paint flow channel and the second buffer space such as the second paint flow channel connect between the application member (nib) and the paint tank. Consequently, for the fountain pens, the paint in the paint tank sequentially passes through the first paint flow channel and the second paint flow channel, and then reaches the application member (nib).

Figure 13:
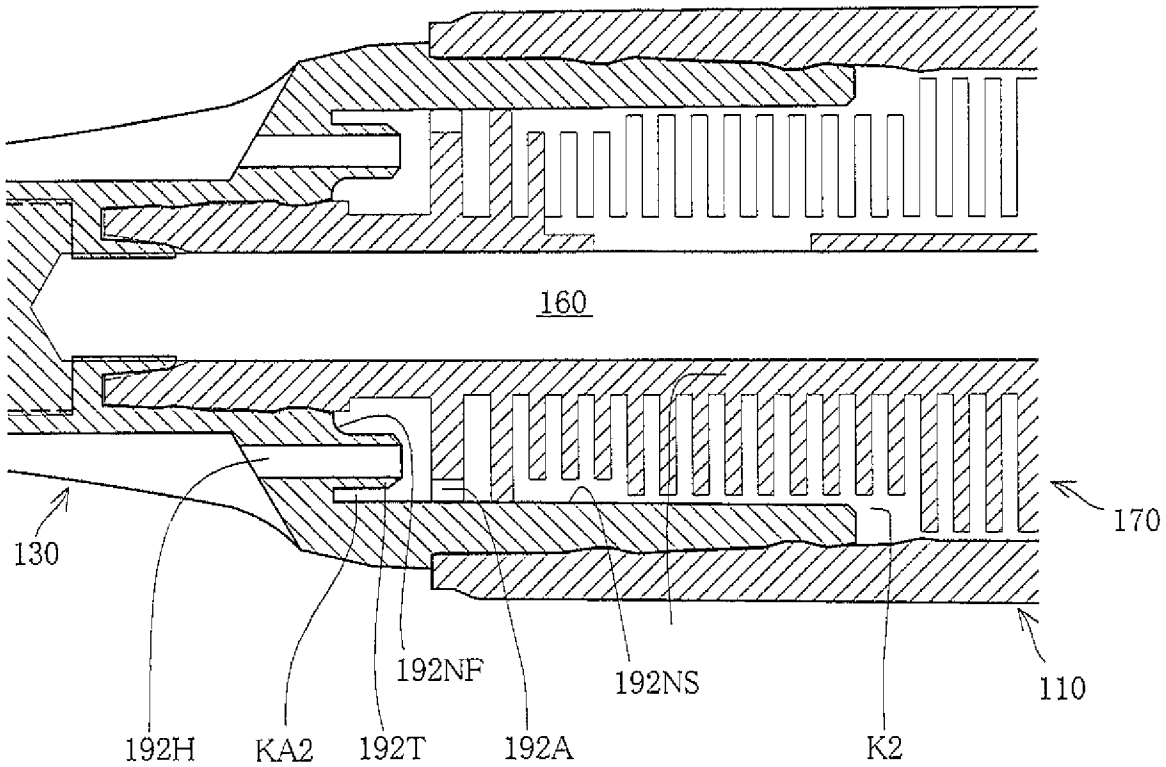
FIG. 13 is an explanatory drawing illustrating the overview of the brush holding member having an air hole.

As shown in FIG. 13, the brush holding member 130 preferably includes an air hole 192H. Since the air hole 192H is provided so as to penetrate through the brush holding member 130, the second buffer space K2 is connected to the external space via the connection hole 192A and the air hole 192H. Here, the air hole 192H extends in the front-rear direction in an inner projected portion 192T that projects from a front-side inner wall surface 192NF of the brush holding member 130 toward the rear side. The formation of the inner projection 192T leads to the formation of a paint reserving space KA2 capable of temporarily reserving the paint discharged from the air hole 192H between the inner projection 192T and a lateral-side inner wall surface 192NS. The connection hole 192A preferably directly faces the paint reserving space KA2. This can prevent paint leakage from the air hole 192H.

Note that the present invention is not limited to the above-described embodiments. It will be appreciated that various modifications are possible without departing from the scope of the present invention.

The invention claimed is:

1. A pressure fluctuation buffering mechanism for buffering fluctuations in a paint flow, comprising:

a buffer space comprising a first buffer zone forming member forming a first buffer zone in the buffer space, the first buffer zone having a plurality of first plates each arranged therein at first intervals, and a second buffer zone member forming a second buffer zone in the buffer space, the second buffer zone having a plurality of second plates each arranged therein at second intervals;

an application member; and a paint flow space through which a paint flows, the paint flow space comprising a paint accommodation space having the paint accommodated therein, a paint feed space connecting the paint accommodation space and the application member and a paint feed core contained in the paint feed space for feeding the paint from the paint accommodation space to the application member, wherein the buffer space is connected to the application member via the paint flow space, the first buffer zone forming member includes a first connection channel for directly connecting between the first buffer zone and the paint feed core, the second buffer zone forming member includes a second connection channel for directly connecting between the second buffer zone and the paint feed core and the width of the first intervals is smaller than the width of the second intervals or the first buffer zone has a higher paint wettability than that of the second buffer zone to enable the paint between the first buffer zone and the paint flow space to flow more easily than the paint between the second buffer zone and the paint flow space.

2. The pressure fluctuation buffering mechanism according to claim 1, wherein the second buffer zone is directly connected to the application member.

3. The pressure fluctuation buffering mechanism according to claim 1, wherein:

the first buffer zone forming member includes a first paint flow channel forming member disposed in the first buffer zone for forming a first paint flow channel, and a first air flow channel forming member disposed in the first buffer zone for forming a first air flow channel;

the second buffer zone forming member includes a second paint flow channel forming member disposed in the second buffer zone for forming a second paint flow channel, and a second air flow channel forming member disposed in the second buffer zone for forming a second air flow channel; and the paint in the first paint flow channel flows more easily than the paint in the second paint flow channel.

4. The pressure fluctuation buffering mechanism according to claim 3, wherein:

the pressure fluctuation buffering mechanism includes a plurality of first plates each provided with a first paint cutout and arranged at predetermined intervals, and a plurality of second plates each provided with a second paint cutout and arranged at predetermined intervals;

the first paint flow channel is formed by a portion between the first plates and the first paint cutout;

the first air flow channel is formed around the plurality of first plates;

the second paint flow channel is formed by a portion between the second plates and the second paint cutout; and the second air flow channel is formed around the plurality of second plates.

5. The pressure fluctuation buffering mechanism according to claim 4, wherein:

the plurality of first plates are each provided with a first air cutout; and the first air cutout forms the first air flow channel.

6. The pressure fluctuation buffering mechanism according to claim 3, wherein the second paint flow channel is opened to the application member.

7. The pressure fluctuation buffering mechanism according to claim 3, wherein the second buffer zone forming member includes an external connection channel for connecting the second air flow channel to an external space, and a paint reserving portion provided in the external connection channel for reserving the paint.

8. The pressure fluctuation buffering mechanism according to claim 1, wherein the second connection channel is positioned between the first connection channel and the application member.

9. The pressure fluctuation buffering mechanism according to claim 1, wherein:

at least one of the first buffer zone and the second buffer zone is provided with an air reserving portion; and the air reserving portion is opposed to the first connection channel via the first paint flow channel formed in the first buffer zone or opposed to the second connection channel via the second paint flow channel formed in the second buffer zone.

10. The pressure fluctuation buffering mechanism according to claim 9, wherein the first connection channel opposed to the air reserving portion or the second connection channel opposed to the air reserving portion functions as a flow channel for the paint and also as a flow channel for the air.

11. The pressure fluctuation buffering mechanism according to claim 1, wherein:

the first buffer zone and the second buffer zone are positioned in the paint feed space.

12. An applicator comprising the pressure fluctuation buffering mechanism according to claim 1.

* * * * *